US008273196B2

(12) United States Patent
Hibino et al.

(10) Patent No.: US 8,273,196 B2
(45) Date of Patent: Sep. 25, 2012

(54) ALUMINUM ALLOY SHEET FOR COLD PRESS FORMING, METHOD OF MANUFACTURING THE SAME, AND COLD PRESS FORMING METHOD FOR ALUMINUM ALLOY SHEET

(75) Inventors: Akira Hibino, Tokyo (JP); Koji Ichitani, Tokyo (JP)

(73) Assignee: Furukawa-Sky Aluminum Corp., Tokyo (JP)

( * ) Notice: Subject to any disclaimer, the term of this patent is extended or adjusted under 35 U.S.C. 154(b) by 2 days.

(21) Appl. No.: 12/331,889

(22) Filed: Dec. 10, 2008

(65) Prior Publication Data

US 2009/0148721 A1 Jun. 11, 2009

(30) Foreign Application Priority Data

Dec. 11, 2007 (JP) ..... 2007-319453
Sep. 3, 2008 (JP) ..... 2008-226006

(51) Int. Cl.
*C22F 1/05* (2006.01)

(52) U.S. Cl. ..... 148/695; 148/714; 148/698

(58) Field of Classification Search ..... 148/714, 148/695, 698, 694, 690
See application file for complete search history.

(56) References Cited

U.S. PATENT DOCUMENTS 6,033,499 A 3/2000 Mitra
RE36,692 E 5/2000 Gupta et al.

FOREIGN PATENT DOCUMENTS

JP 4-351229 A 12/1992
JP 05044000 A * 2/1993
JP 2000-117338 A 4/2000
JP 2006-205244 A 8/2006
NL 1017202 C6 * 7/2001

OTHER PUBLICATIONS

'Aluminum and Aluminum Alloys', ASM International, 1993, p. 236.*

(Continued)

*Primary Examiner* — Roy King
*Assistant Examiner* — Janelle Morillo
(74) *Attorney, Agent, or Firm* — Birch, Stewart, Kolasch & Birch, LLP

(57) ABSTRACT

An Al—Mg—Si based aluminum alloy sheet having undergone normal-temperature aging (or being in a underaged state) after a solution treatment thereof is, before press forming, subjected to a heating treatment (partial reversion heating treatment) in which the alloy sheet is partially heated to a temperature in the range of 150 to 350° C. for a time of not more than 5 minutes so that the difference in strength (difference in 0.2% proof stress) between the heated part and the non-heated part will be not less than 10 MPa. The alloy sheet thus treated is subjected to cold press forming in the condition where the heated part with low strength is put in contact with a wrinkle holding-down appliance of the press and the non-heated part with high strength is put in contact with the shoulder part (radius) of the punch. In the partial reversion heating treatment, the temperature rise rate and the cooling rate in cooling down to 100° C. or below are set to be not less than 30° C./min. Further, the period for which the alloy sheet is left to stand at normal temperature after the partial reversion heating treatment until the cold press forming is set to be within 30 days.

6 Claims, 4 Drawing Sheets

OTHER PUBLICATIONS

Vollertsen et al., "Enhancement of Drawability by Local Heat Treatment", Annals of the CIRP, vol. 47, No. 1, pp. 181-184, 1998, XP022137461.
Hofmann, A., "Deep drawing of process optimized blanks", Journal of Materials Processing Technology, vol. 119, pp. 127-132, 2001, XP002514050.
Geiger et al., "Finite Element Simulation of Deep Drawing of Tailored Heat Treated Blanks", Annals of the CIRP, vol. 53, No. 1, pp. 223-226, 2004, XP022135580.
Chevigny et al., "Reversion Heat Treatment", Revue de Metallurgie, vol. 45, pp. 447-454, 1948, XP009111841.
Beckmann et al., "Methods of local short-term heat treatment of 6000 series aluminum alloys", Metall, vol. 56, Nos. 7-8, pp. 462-467, 2002, XP009111952.
Vollertsen et al., "Drawing of process-optimized tailored blanks", Blech, Rohre, Profile, vol. 45, No. 4, pp. 44-46, 48, 1998, XP009111950.
Vollertsen, F., "Challenges and Chances of Hydroforming of Aluminum Alloys", DVS-Berichte, vol. 218, pp. 71-79, 2001. XP009111951.

* cited by examiner

ALUMINUM ALLOY SHEET FOR COLD PRESS FORMING, METHOD OF MANUFACTURING THE SAME, AND COLD PRESS FORMING METHOD FOR ALUMINUM ALLOY SHEET

CROSS-REFERENCE TO RELATED APPLICATION

This non-provisional application claims priority under 35 U.S.C. §119(a) on Patent Application Nos. 2007-319453 and 2008-226006 filed in Japan on Dec. 11, 2007 and Sep. 3, 2008, respectively, the entire contents of which are hereby incorporated by reference.

TECHNICAL FIELD

The present invention relates to an Al—Mg—Si based aluminum alloy sheet to be used after subjected to forming, particularly cold press forming, and baking of a coating thereon, a method of manufacturing the same, and a cold press forming method using the same. More particularly, the invention relates to an Al—Mg—Si based aluminum alloy sheet to be used preferably for various members and component parts of automobile, ships, aircrafts, etc., or as building materials, structural materials, or for various apparatuses, household electric appliances, their component parts, etc., such as automobile body sheets and body panels.

BACKGROUND ART

Conventionally, automobile body sheets were obtained mainly by using cold rolled steel sheets in the past. Recently, however, rolled aluminum alloy sheets have come to be frequently used as a result of wide recognition of the importance of reductions in the weight of vehicle bodies, in response to the demand for reductions in the quantity of $CO_2$ emission from the viewpoint of suppressing global warming. Meanwhile, rolled aluminum alloy sheets are generally inferior to cold rolled steel sheets in formability, which hampers wider use thereof. In order to enhance the formability of the rolled aluminum alloy sheets, an improvement in the formability of the blank material itself and ingenious contrivances in the method of forming the blank material are keenly demanded.

Besides, in such a kind of use, the rolled sheets are normally subjected to baking of coatings thereon, prior to use thereof. Therefore, the rolled sheets are required of a property for promising high strength after the baking (bake hardenability, or BH performance).

JP-A 4-351229 and 2006-205244 propose application of a warm deep drawing method for enhancing the formability of aluminum alloy sheets. The warm forming method does make it possible to enhance the deep drawability of aluminum alloy sheets, but application of the method to large-scale industrial production involves some problems.

Specifically, the warm deep drawing method is characterized by the need to perform deep drawing in the condition where heating of a flange part and cooling of a punch-corresponding part are being conducted. This leads to the following problems:

1. The press must be provided with functions for heating and cooling the aluminum alloy sheet, so that a longer total forming time is needed as compared with the case of cold press forming, leading to a lowered production efficiency and an increased forming cost.

2. Since forming is conducted in a warm condition, an ordinary lubricant for cold forming cannot be used, and, therefore, development of a novel lubricant is needed.
3. The press is complicated in configuration, resulting in a raised equipment cost.
4. As the press is complicated more, there arises uneasiness about quality control.

Meanwhile, the warm deep drawing method is a method wherein that part of an aluminum alloy sheet blank to be formed at which the extent of working will be large is locally heated and softened, prior to the forming. Paying attention to the moment of forming, therefore, the warm deep drawing method can be said to be a method in which enhanced formability is contrived by locally imparting a strength difference to the aluminum alloy sheet blank. In this connection, as other methods for similarly contriving enhanced formability by providing a strength difference to the aluminum alloy sheet blank, a method in which the blank is preliminarily subjected to a local heat treatment has been known (refer to, for example, JP-A 2000-117338 (hereinafter referred to Patent Document 3)). This method is considered to be particularly effective when applied to age-hardenable alloys in which a large change in strength is obtainable through solutionizing and precipitation in the matrix by a heat treatment, such as the Al—Mg—Si based alloy used mainly for automobile body sheets.

Here, in the technology disclosed in Patent Document 3, the strength difference is induced in the alloy sheet blank by utilizing the fact that, during when the Al—Mg—Si based alloy sheet to be shipped after a solution treatment at an aluminum rolling maker is held at room temperature, extremely fine precipitates composed of Mg and Si are formed evenly and finely in the matrix due to normal-temperature aging, whereby the strength is enhanced as compared with the strength immediately upon the solution treatment. Specifically, in the technology according to Patent Document 3, it is described that a local strength difference can be imparted to the aluminum alloy sheet by a treatment carried out comparatively inexpensively and in a short time, through utilizing the fact that the above-mentioned precipitates formed at room temperature are easily re-dissolved by heating to a comparatively low temperature of 250° C. or above for a short time, whereby the strength at the heated part is lowered.

Meanwhile, in the technology disclosed in Patent Document 3, the formability of an aluminum alloy sheet blank is enhanced on the premise that the blank is press formed in the condition where the periphery thereof is perfectly fixed by clamping; thus, that region in the blank surface which underlies and is to be contacted by the punch at the time of press forming, exclusive of the region to be contacted by a shoulder part of the punch, is softened by heating so as to contrive enhanced formability. In this case, however, a problem has been found in that strain is concentrated in the region underlying the punch and being softened, and the sheet thickness is considerably lowered locally in this region, leading to a lowered rigidity of the formed product. In addition, since the press forming is conducted in the condition where the periphery of the blank is perfectly fixed, inflow of material from the peripheral held-down part of the blank is not permitted at all, so that the extent of enhancement of formability is limited. Further, in the case of an automobile body sheet being in consideration, bending at a peripheral part of the formed product (hemming) is often conducted after press forming. In this connection, in the technology of Patent Document 3, the sheet region underlying the punch, namely, a central part of the sheet is heated, whereas the peripheral part of the sheet is left in the state upon age precipitation due to normal-temperature aging, and bendability is very poor in this peripheral part, leading to cracking in the bent part.

DISCLOSURE OF THE INVENTION

With the forming of the Al—Mg—Si based alloy sheet according to the related art as above-mentioned, it has been difficult to sufficiently satisfy the formability and other performances required of the automobile body sheets nowadays.

Specifically, recently, high design quality has come to be required of the automobile panel shape, attended by demand for higher formability, particularly, higher drawability of material as compared with those in the related art. In addition, naturally, not only the enhancement of a formability index such as drawability but also the enhancement of drawability while preventing deterioration of bendability (hemmability), strength or the like is demanded. Further, high productivity in forming is also demanded. From these points of view, the conventional methods for forming Al—Mg—Si based alloy sheets have yet been unsatisfactory.

The present invention has been made in consideration of the above-mentioned circumstances. Accordingly, it is an object of the present invention to provide an Al—Mg—Si based aluminum alloy sheet excellent in formability with which both securing of high formability of the aluminum alloy sheet and maintaining of high productivity in forming can be promised, and a strength difference in material can be tactfully utilized without deteriorating other characteristics demanded, as well as a method of manufacturing the same, and a press forming method using the same.

Specifically, a technology in which an aluminum alloy sheet blank is preliminarily subjected to a partial heat treatment (reversion treatment) so as to impart thereto a strength difference in the sheet blank surface is fundamental to the present invention. A blank optimized in strength distribution by appropriately adjusting the heated part in a partial reversion heating treatment, in order to permit inflow of material from a held-down peripheral part in cold drawing, is subjected to cold deep drawing. This promotes the inflow of material from the peripheral part of the blank, making it possible to manufacture a formed product with a uniform sheet thickness and a deep drawing. In addition, bending applied to a peripheral part of the formed product is facilitated. Further, the time required for the preliminary heating treatment is shortened, while maintaining the coating bake hardenability of the heated part, so as not to spoil the high production efficiency of the conventional cold press forming.

The present inventors made various experiments and investigations for solving the above-mentioned problems. As a result of the experiments and investigations, it was found out that when an age-precipitated aluminum alloy sheet, or an aluminum alloy sheet subjected to normal-temperature aging or artificial aging after a solution treatment, is subjected to a partial reversion heating treatment for enhancing deep drawability and bendability, it is important to optimally select the heated part in the partial reversion heating treatment. It was also found out that by optimizing the reached heating temperature in the partial reversion heating treatment, the temperature rise rate in the heating, and the cooling rate after the heating is over, the relevant part of the sheet can be efficiently softened in an extremely short time by restoration, bendability of the sheet can also be enhanced, and a high coating bake hardenability can be imparted to the sheet. Based on these findings, the present invention has been attained.

The "reversion" herein means the phenomenon in which an age-hardenable aluminum alloy is rapidly cooled after a solution treatment so as to dissolve the alloying elements to a supersaturated level at room temperature, then the alloy is held at room temperature or a temperature slightly higher than room temperature so as to form very fine precipitates in the matrix of the alloy, thereby enhancing the strength of the alloy, and thereafter the alloy is heated at a temperature above the holding temperature for a short time so as to cause re-dissolution of the fine precipitates, thereby lowering the strength. In addition, the treatment of heating the material having been held at the above-mentioned temperature after the solution treatment (solutionizing treatment) so as to cause this phenomenon referred to as the "reversion heating treatment." Besides, the "partial" reversion heating treatment herein means a treatment in which only a predetermined part (region) in the surface of the aluminum alloy sheet blank is selectively heated for restoration so that only the predetermined part is softened.

According to one embodiment of the present invention, there is provided an aluminum alloy sheet for cold press forming, comprised of an Al—Mg—Si based aluminum alloy and having been subjected to a partial reversion heating treatment so that the difference in 0.2% proof stress after cooling to normal temperature between a heated part thereof and a non-heated part thereof is not less than 10 MPa.

In the aluminum alloy sheet for cold press forming, preferably, a region of the sheet which is to be held down by a wrinkle holding-down appliance at the time of cold press forming is set to be the heated part, and a region of the sheet against which a punch shoulder part is to be pressed at the time of cold press forming is set to be the non-heated part.

According to another embodiment of the present invention, there is provided an aluminum alloy sheet for cold press forming, comprised of an Al—Mg—Si based aluminum alloy, and having been subjected to a partial reversion heating treatment in the condition where a region of the sheet to be held down by a wrinkle holding-down appliance at the time of cold press forming is set to be a heated part and a region of the sheet against which a punch shoulder part is to be pressed at the time of cold press forming is set to be a non-heated part, in such a manner that the difference between the tensile strength of the heated part and the 0.2% proof stress of the non-heated part is increased by not less than 20 MPa through the partial reversion heating treatment.

According to a further embodiment of the present invention, there is provided a method of manufacturing an aluminum alloy sheet for cold press forming, including the steps of preparing as a blank material a rolled Al—Mg—Si based aluminum alloy sheet rolled to a predetermined sheet thickness, subjecting the rolled sheet to a solution treatment at a temperature in the range of 480 to 590° C., thereafter leaving the rolled sheet to stand at normal temperature for at least one day, and, before cold press forming, subjecting the rolled sheet to a partial reversion heating treatment so that the difference in 0.2% proof stress after cooling to normal temperature between a heated part and a non-heated part will be not less than 10 MPa.

In the manufacturing method as just-mentioned, preferably, the partial reversion heating treatment is conducted in the condition where a region of the sheet which is to be held down by a wrinkle holding-down appliance at the time of cold press forming is set to be the heated part and a region of the sheet against which a punch shoulder part is to be pressed at the time of cold press forming is set to be the non-heated part.

In the manufacturing method, preferably, the partial reversion heating treating includes the steps of heating the rolled sheet at a temperature rise rate of not less than 30° C./min to a temperature in the range of 150 to 350° C., holding the rolled sheet at a temperature in the range for a time of not more than 5 minutes (inclusive of a time of 0 second), and thereafter cooling the rolled sheet at a cooling rate of not less than 30° C./min to a temperature of 100° C. or below.

In the manufacturing method, preferably, the partial reversion heating treatment includes the steps of heating the rolled sheet at a temperature rise rate of not less than 50° C./min to a temperature in the range of 180 to 350° C., holding the rolled sheet at a temperature in the range for a time of not more than 5 minutes (inclusive of a time of 0 second), and thereafter cooling the rolled sheet at a cooling rate of not less than 50° C./min to a temperature of 100° C. or below, whereby the difference between the tensile strength of the heated part and the 0.2% proof stress of the non-heated part is increased by not less than 20 MPa through the partial reversion heating treatment.

According to yet another embodiment of the present invention, there is provided a method of performing cold press forming using an aluminum alloy sheet for cold press forming manufactured by the above-mentioned manufacturing method, wherein the cold press forming is conducted before the sheet is left to stand at normal temperature for 30 days after the partial reversion heating treatment.

According to a yet further embodiment of the present invention, there is provided a cold press forming method for an aluminum alloy sheet, based on application of a process in which an Al—Mg—Si based aluminum alloy sheet blank in an age-precipitated state due to normal-temperature aging is cold press formed by use of a punch and with an end part thereof held down, wherein of the aluminum alloy sheet blank, the whole part or a smaller-than-whole part of a portion on the outer side of a region to be contacted by a punch shoulder part at the time of press forming is set to be a heated part, while the other part than said heated part is set to be a non-heated part; the aluminum sheet blank is subjected to a partial reversion heating treatment in which the heated part is rapidly heated to momentarily dissolve age-precipitates and thereby to soften the heated part, while the non-heated part is not heated, whereby the strength of the heated part is lowered as compared with the strength of the non-heated part, followed by rapidly cooling the heated part to room temperature; and thereafter, before the strength of the heated part is returned to the level before the partial reversion heating treatment due to age precipitation during holding at room temperature, the aluminum alloy sheet blank is subjected to cold press forming.

According to still another embodiment of the present invention, there is provided a cold press forming method for an aluminum alloy sheet, based on application of a process in which an Al—Mg—Si based aluminum alloy sheet put into a sub-aged state by artificial aging at or below 140° C., or an aging treatment conducted by combining normal-temperature aging with artificial aging at or below 140° C., after a solution treatment and having a 0.2% proof stress of not less than 90 MPa is cold press formed by use of a punch and with an end part thereof held down, wherein of the aluminum alloy sheet blank, the whole part or a smaller-than-whole part of a portion on the outer side of a region to be contacted by a punch shoulder part at the time of press forming is set to be a heated part, while the other part than the heated part is set to be a non-heated part; the aluminum alloy sheet blank is subjected to a partial reversion heating treatment in which the heated part is rapidly heated to momentarily dissolve age-precipitates and thereby to soften the heated part, while the non-heated part is not heated, whereby the strength of the heated part is lowered as compared with the strength of the non-heated part, followed by rapidly cooling the heated part to room temperature; and thereafter, before the strength of the heated part is returned to the level before the partial reversion heating treatment due to age precipitation during holding at room temperature, the aluminum alloy sheet blank is subjected to cold press forming.

In the cold press forming method, preferably, the partial reversion heating treating includes the steps of heating the sheet blank at a temperature rise rate of not less than 30° C./min to a temperature in the range of 150 to 350° C., holding the sheet blank at a temperature in the range for a time of not more than 5 minutes (inclusive of a time of 0 second), and thereafter cooling the sheet blank at a cooling rate of not less than 30° C./min to a temperature of 100° C. or below.

In the cold press forming method, preferably, the partial reversion heating treatment includes the steps of heating the sheet blank at a temperature rise rate of not less than 50° C./min to a temperature in the range of 180 to 350° C., holding the sheet blank at a temperature in the range for a time of not more than 5 minutes (inclusive of a time of 0 second), and thereafter cooling the sheet blank at a cooling rate of not less than 50° C./min to a temperature of 100° C. or below, whereby the difference between the tensile strength of the heated part and the 0.2% proof stress of the non-heated part is increased by not less than 20 MPa through the partial reversion heating treatment.

In the cold press forming method, preferably, a part, to be subjected to bending after cold press forming, of a portion on the outer side of a region of the aluminum alloy sheet blank which is to be contacted by a punch shoulder part at the time of cold press forming is included in the heated part in the partial reversion heating treatment.

In the cold press forming method, preferably, the whole area inside a region of the aluminum alloy sheet blank which is to be contacted by a punch shoulder part at the time of cold press forming, or arbitrary-shaped one or more areas inside the region, are included in the heated part in the partial reversion heating treatment.

According to a still further embodiment of the present invention, there is provided a cold press formed aluminum alloy product obtained by the above-mentioned cold press forming method for an aluminum alloy sheet, wherein the proof stress of the heated part is enhanced by not less than 20 MPa by an artificial aging treatment conducted within 30 days after the partial reversion heating treatment.

In the above-mentioned aluminum alloy sheet for cold press forming, preferably, the Al—Mg—Si based aluminum alloy sheet includes an aluminum alloy sheet containing 0.2 to 1.5% (mass %, the same applies hereinafter) of Mg, and 0.3 to 2.0% of Si, and containing at least one selected from among 0.03 to 1.0% of Fe, 0.03 to 0.6% of Mn, 0.01 to 0.4% of Cr, 0.01 to 0.4% of Zr, 0.01 to 0.4% of V, 0.005 to 0.3% of Ti, 0.03 to 2.5% of Zn, and 0.01 to 1.5% of Cu, with the balance being Al and unavoidable impurities.

In the above-mentioned method of manufacturing an aluminum alloy sheet for cold press forming, preferably, the Al—Mg—Si based aluminum alloy sheet includes an aluminum alloy sheet containing 0.2 to 1.5% of Mg, and 0.3 to 2.0% of Si, and containing at least one selected from among 0.03 to 1.0% of Fe, 0.03 to 0.6% of Mn, 0.01 to 0.4% of Cr, 0.01 to 0.4% of Zr, 0.01 to 0.4% of V, 0.005 to 0.3% of Ti, 0.03 to 2.5% of Zn, and 0.01 to 1.5% of Cu, with the balance being Al and unavoidable impurities.

In the above-mentioned cold press forming method for an aluminum alloy sheet, preferably, the Al—Mg—Si based aluminum alloy sheet includes an aluminum alloy sheet containing 0.2 to 1.5% of Mg, and 0.3 to 2.0% of Si, and containing at least one selected from among 0.03 to 1.0% of Fe, 0.03 to 0.6% of Mn, 0.01 to 0.4% of Cr, 0.01 to 0.4% of Zr, 0.01 to 0.4% of V, 0.005 to 0.3% of Ti, 0.03 to 2.5% of Zn, and 0.01 to 1.5% of Cu, with the balance being Al and unavoidable impurities.

BENEFITS OF THE INVENTION

In accordance with the present invention, a held-down peripheral part of an Al—Mg—Si based aluminum alloy sheet having undergone normal-temperature aging after a solution treatment (solutionizing treatment), or of an Al—Mg—Si based aluminum alloy sheet having undergone artificial aging or an aging treatment obtained by combining normal-temperature aging and artificial aging after the solution treatment (solutionizing treatment) and being in a underaged state, is subjected to heating (partial reversion heating treatment) so as to render the part a low-strength part through a reversion phenomenon, thereby imparting a strength difference between the held-down peripheral part as the heated part and a punch shoulder part contact part as a non-heated part, whereby press formability of the alloy sheet can be enhanced. Moreover, since the partial reversion heating treatment is carried out before the cold press forming and as other step than the cold press forming, the press forming itself can be carried out at high speed by use of a conventional cold pressing machine. Therefore, an increase in the equipment cost for the press or a lowering in production efficiency, as in the case of applying warm forming, can be obviated, and the need for a special lubricant is eliminated.

Besides, in accordance with the present invention, with the held-down peripheral part lowered in strength, the shape freeze performance of the formed product is enhanced. In addition, since the part lowered in strength through the reversion phenomenon is high in the rate of hardening at the time of baking of the coating thereon and its strength is rapidly recovered, a high coating age-hardenability (BH performance) can be obtained, so that it is possible to prevent the strength from being lowered after the baking of the coating. Further, by optimal selection of the region to be subjected to reversion heating, bendability of the formed product can be enhanced.

DESCRIPTION OF THE PREFERRED EMBODIMENTS

Figure 1:
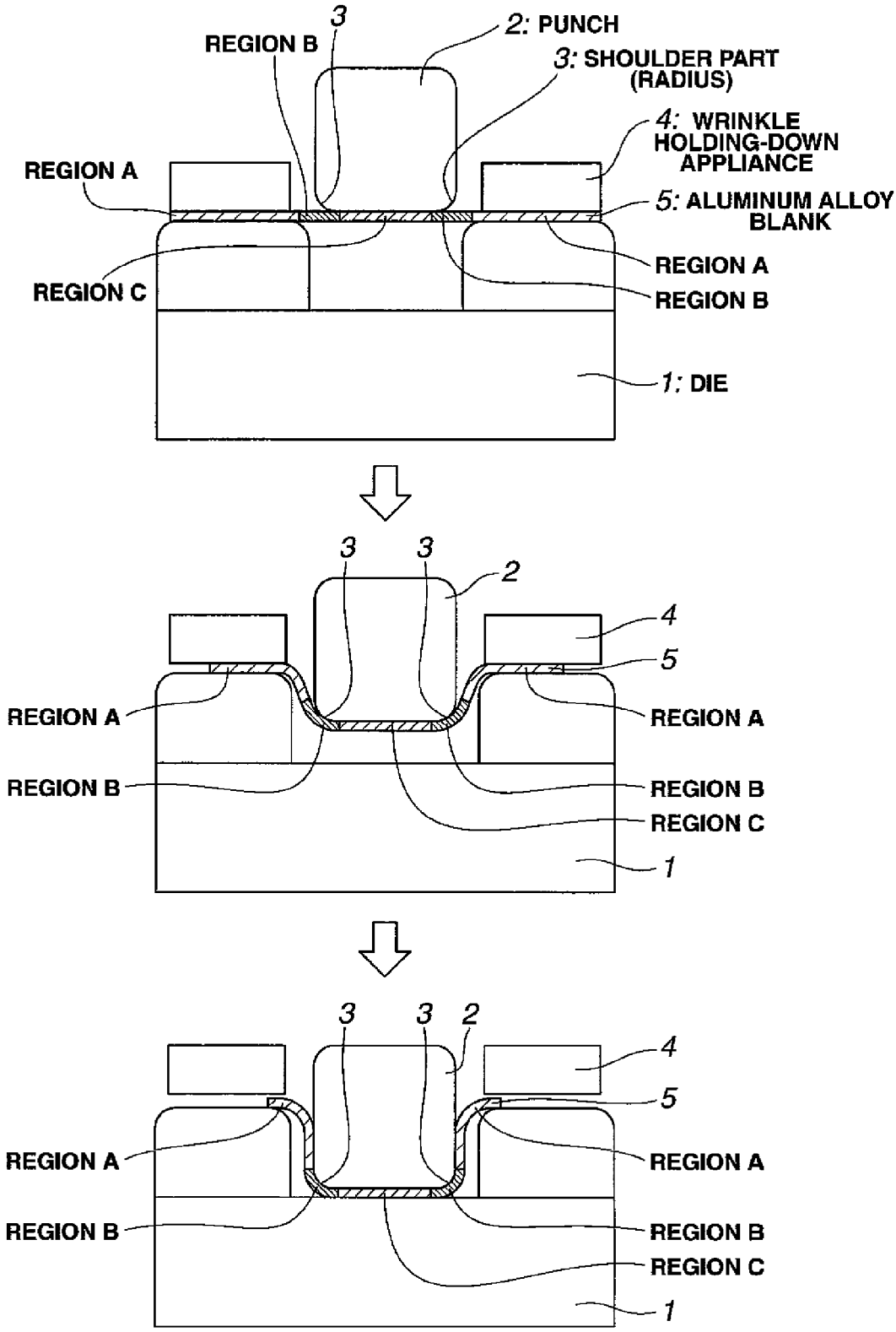
FIG. 1 shows schematic sectional views showing stepwise the proceeding of press forming of an aluminum alloy sheet, for illustrating a heated part and a non-heated part during a partial reversion heating treatment according to the present invention.

An aluminum alloy sheet used in the present invention is basically an Al—Mg—Si based aluminum alloy sheet which is in an age-precipitated state due to normal-temperature aging after a solution treatment (solutionizing treatment) at a high temperature or which is in a underaged state due to artificial aging or an aging treatment obtained by combining normal-temperature aging and artificial aging that is effected after a solution treatment at a high temperature. In view of this, the present invention will now be described in detail below, according to main items thereof.

Method of Manufacturing Aluminum Alloy Sheet for Cold Press Forming

First, as to the method of manufacturing an aluminum alloy sheet for cold press forming, basically, the blank material constituting an aluminum alloy blank to be formed by a forming method according to the present invention can be manufactured by a method generally used in the aluminum alloy manufacturing industry.

Specifically, a melt of an aluminum alloy melted and conditioned to a predetermined composition is cast by an appropriately selected one of ordinary methods for melting and casting. Examples of the ordinary method for melting and casting include the semi-continuous casting method (DC casting method) and thin-sheet continuous casting method (roll casting method, etc.). Next, the aluminum alloy ingot thus obtained is subjected to a homogenizing treatment at a temperature of 480° C. or above. The homogenizing treatment is a step necessary for moderating the microsegregation of alloying elements at the time of solidification of the melt, and, in the case of an alloy melt containing Mn and Cr and other various transition elements, for precipitation of disperse particles of intermetallic compounds consisting mainly of these elements into the matrix uniformly and in a high density. The heating time in the homogenizing treatment is normally not less than one hour, and the heating is normally finished in 48 hours for an economic reason. It is to be noted here that the heating temperature in the homogenizing treatment is close to the heating treatment temperature in heating to a hot rolling start temperature prior to hot rolling; therefore, the homogenizing treatment can be conducted by a heating treatment which functions both as the heating for homogenization and as the pre-hot-rolling heating. After facing is appropriately carried out before or after the homogenizing treatment, hot rolling is started at a temperature in the range of 300 to 590° C., and thereafter cold rolling is conducted, to produce an aluminum alloy sheet with a predetermined thickness. Intermediate annealing may be conducted, as required, in the course of the hot rolling, between the hot rolling and the cold rolling, or in the course of the cold rolling.

Next, the aluminum alloy sheet obtained upon the cold rolling is subjected to a solution treatment (solutionizing treatment). The solution treatment is an important step for dissolving $Mg_2Si$, elemental Si and the like into the matrix, thereby imparting bake hardenability to the alloy sheet and enhancing the strength of the alloy sheet after baking of the coating thereon. Besides, this step contributes also to enhancement of ductility and bendability by lowering the distribution density of second-phase particles through dissolution (in solid solution) of the $Mg_2Si$, elemental Si particles and the like; further, this step is important for obtaining good formability through recrystallization. For these effects to be exhibited, the treatment has to be carried out at 480° C. or above. Incidentally, when the solution treatment temperature exceeds 590° C. eutectic melting may take place. Accordingly, the solution treatment is conducted at 590° C. or below.

Here, the solution treatment (solutionizing treatment) can be efficiently carried out by a method wherein the cold rolled sheet taken up in a coiled form is continuously passed through a continuous annealing furnace having a heating zone and a cooling zone. In the treatment by use of such a continuous annealing furnace, the aluminum alloy sheet is heated to a high temperature in the range of 480 to 590° C. when passing through the heating zone, and is thereafter rapidly cooled when passing through the cooling zone. By such a series of treatment stages, Mg and Si serving as main alloying elements in the alloy adopted as the objective material in the present invention are once dissolved into the matrix at the high temperature, and, upon the subsequent rapid cooling, the elements are put into a supersaturatedly dissolved state at room temperature.

Aging During Period from Solution Treatment to Reversion Heating Treatment

In order to provide a strength difference between a heated part and a non-heated part of the alloy sheet by a partial reversion heating treatment, it is necessary that a certain amount of clusters or fine precipitates should have been formed by normal-temperature aging (natural aging) during the period for which the alloy sheet is left to stand at normal temperature after the solution treatment. But for such clusters or fine precipitates, the reversion phenomenon desired would not occur even in the heated part in the subsequent partial reversion heating treatment, and, therefore, the intended lowering in the strength of the heated part by the partial reversion heating treatment would not be realized. After the solution treatment, therefore, the alloy sheet has to be left to stand at normal temperature for at least one day, by the time of the partial reversion heating treatment. Incidentally, the period for which the rolled sheet is left to stand at normal temperature after the solution treatment at a blank material maker and before the forming at a forming maker is not less than 10 days, in general. Besides, the normal-temperature aging proceeds early in the beginning period, but, after the lapse of a time of about half a year, further progress of the normal-temperature aging is less liable to occur. In view of this, there is no upper limit particularly set to the period for which the alloy sheet is left to stand at normal temperature before the reversion heating treatment. The "normal temperature" here, specifically, means a temperature in the range of 0 to 40° C.

While only the normal-temperature aging has been described in regard of the aging after the solution treatment in the above description, according to the present invention, even in the case of artificial aging conducted after the solution treatment or in the case where a combination of normal-temperature aging and artificial aging is conducted after the solution treatment, a strength difference can be imparted to the alloy sheet blank by the partial reversion heating treatment subsequent to the aging. In the case where artificial aging is conducted, the strength of the alloy sheet blank as a whole before the partial reversion heating can be enhanced earlier, as compared with the case of the normal-temperature aging alone. It is to be noted here, however, that the artificial aging temperature is not higher than 140° C., and the aluminum alloy sheet after the artificial aging treatment has to be in a underaged state. Where the artificial aging temperature is higher than 140° C., the precipitates composed of Mg and Si formed by precipitation would be coarse, so that the precipitates would not easily be dissolved in solid solution in a short time by the subsequent partial reversion heating treatment. As a result, softening through restoration takes a long time, which lowers the productivity of press forming. In addition, in the case where the artificial aging temperature is not higher than 140° C. but the artificial aging is conducted for such a long time as to bring the alloy sheet blank into a post-peak-aging state or an over-aged state, also, the precipitates composed of Mg and Si formed by precipitation would be coarse, so that the precipitates would not easily be dissolved in the partial reversion heating treatment, and the restoration takes a long time. From these points of view, a more preferable artificial aging temperature is below 100° C.

In the present invention, as for the material strength after the above-mentioned aging and immediately before the subsequent partial reversion heating treatment, the proof stress value (0.2% proof stress) of the material is desirably not less than 90 MPa. When the strength in terms of proof stress is below 90 MPa, the lowering in strength at the part restored by being heated in the subsequent partial reversion heating treatment would be insufficient, it would be difficult to impart a satisfactory strength difference to the material, and it would hence be difficult to sufficiently enhance the formability thereof. Incidentally, a more preferable proof stress value is not less than 110 MPa.

Partial Reversion Heating Treatment

The most important characteristic in the present invention lies in that the Al—Mg—Si based aluminum alloy sheet aged as above-mentioned is, before cold press forming, subjected to partial (this means "partial" in regard of location in a two-dimensional surface, and does not mean "partial" in regard of extend or degree) heating (reversion heating treatment), in such a manner that the strength difference (difference in 0.2% proof stress) between the heated part (the part heated in the partial reversion heating treatment) and the non-heated part after cooling to normal temperature will be not less than 10 MPa.

Here, the limit of deep drawing is known to be determined by the magnitude relationship between the breaking strength of the punch shoulder part contact part and the inflow resistance of the held-down peripheral part (flange part). Usually, an aluminum alloy sheet for an automobile body sheet is left to stand at normal temperature throughout the period from the blank material solution treatment at the manufacturing maker to the press forming at the user (forming maker). Since the Al—Mg—Si based alloy is an age-hardenable alloy, if the normal-temperature leaving period (the period of time for which the alloy sheet is left to stand at normal temperature) is long the material strength would be enhanced due to normal-temperature aging during the normal-temperature leaving period. If the alloy sheet in this state is directly subjected to cold press forming, press formability would be lowered due to the high inflow resistance of the held-down peripheral part of the alloy sheet.

On the other hand, when the alloy sheet is subjected to a partial heating treatment before cold press forming, the clusters and/or fine precipitates formed through normal-temperature aging (or artificial aging or a combination of normal-temperature aging and artificial aging) are decomposed and re-dissolved in solid solution, so that the heated part of the alloy sheet undergoes a lowering in strength, i.e., the reversion phenomenon. The present invention just utilizes such a phenomenon, and the amount of lowering in strength in that case has to be not less than 10 MPa.

More specifically, at the time of performing cold press forming, the heated part lowered in strength by not less than 10 MPa is put in contact with the wrinkle holding-down appliance of the press, whereas the non-heated part kept at a high strength obtained by normal-temperature aging (or artificial aging or a combination of normal-temperature aging and artificial aging) is put in contact with the shoulder part (radius) of the punch. This makes it possible to enhance the press formability, and to prevent the hemmability from being lowered and to prevent the strength of the heated part from being lowered after baking of the coating thereon. Incidentally, in order to further enhance the press formability, it is desirable to set the strength difference between the heated part and the non-heated part of the alloy sheet to a value of not less than 20 MPa.

As a result of the present inventors' further investigations, it has been found out to be essentially effective that the difference between the tensile strength of the non-heated part at room temperature and the proof stress of the heated part at room temperature is enlarged by not less than 20 MPa through the partial reversion heating. With such a large strength difference imparted, the resistance to inflow of material from the held-down peripheral part having been relatively lowered in strength (the proof stress of the held-down peripheral part) at the time of drawing is lowered, which ensures that the material strength (tensile strength) of the punch shoulder part contact part relatively higher in strength can endure a larger material inflow, with the result that deeper drawing is possible. Thus, the method in which the difference between the tensile strength at the non-heated part and the proof stress at the heated part that is essentially important for enhancing the drawability is taken as an index and the index is enlarged through the partial reversion heating has been found out to be effective in enhancing the deep drawability of the alloy sheet. Incidentally, in the case where the increase (increment) in the difference between the tensile strength of the non-heated part at room temperature and the proof stress of the heated part at room temperature by the partial reversion heating treatment is less than 20 MPa, it is impossible to achieve sufficient enhancement of formability.

Here, the tensile strength and the proof stress in the state before the partial reversion heating treatment can usually be deemed as substantially uniform throughout the alloy sheet blank. Therefore, tensile strength and proof stress values obtained by tensile tests for tensile test specimens sampled from arbitrary positions of an alloy sheet blank can respectively be deemed as the tensile strength of the non-heated part before the partial reversion heating treatment and as the proof stress of the heated part before the treatment. On the other hand, in the state after the partial reversion heating treatment, the heated part and the non-heated part differ from each other in strength; therefore, the tensile tests have to be conducted for tensile test specimens sampled from the respective portions. Here, the "non-heated part" means a portion (region) where the lowering in strength by the partial reversion heating treatment is not intended. Depending on the performance of the partial reversion heating treatment and/or the reached heating temperature in the partial reversion heating treatment, however, the non-heated part may suffer a certain extent of temperature rise due to the heat (remaining heat) transferred from the heated part. In the case where the partial reversion heating treatment is conducted in an ideal mode in which the non-heated part does not substantially suffer any temperature rise, the tensile strength of the non-heated part is equivalent to the tensile strength before the partial reversion heating treatment. In this case, therefore, the decrease in the proof stress at the heated part is the increase amount (increment) by which the difference between the tensile strength of the non-heated part at room temperature and the proof stress of the heated part at room temperature is increased through the partial reversion heating treatment. On the other hand, there may be a case in which, depending on the method and conditions of the partial reversion heating, the temperature of the non-heated part is raised in a certain extent due to the partial reversion heating treatment, with the result of slight restoration, whereby the tensile strength of the non-heated part is a little lowered. Even in such a case, however, the press formability of the alloy sheet blank can be substantially enhanced by the partial reversion heating treatment insofar as the increase amount (increment) of the difference between the tensile strength of the non-heated part at room temperature and the proof stress of the heated part at room temperature through the partial reversion heating treatment is not less than 20 MPa, as specified in the present invention. This is the reason why the increase amount (increment) of the tensile strength of the non-heated part at room temperature and the proof stress of the heated part at room temperature through the partial reversion heating treatment is taken as an index in the present invention.

Details of Portion to be Subjected to Partial Reversion Heating Treatment

Now, the portion to be heated and the portion not to be heated, in the partial reversion heating treatment, will be described in detail below.

Basically, the portion to be heated is so selected that the heated part with a low strength is put in contact with the wrinkle holding-down appliance of the press whereas the non-heated part with a high strength is put in contact with the shoulder part (radius) of the punch. The proceeding condition of the press forming for deep drawing is schematically illustrated in FIG. 1, and the portion to be subjected to the partial reversion heating will be described below referring to FIG. 1. In FIG. 1, symbol 1 denotes a die, 2 denotes a punch, 3 denotes a shoulder part (radius) of the punch 2, 4 denotes a wrinkle holding-down appliance, and 5 denotes an aluminum alloy sheet blank. In the partial reversion heating treatment, it is effective that, of the aluminum alloy sheet blank 5 shown in FIG. 1, the whole part of a smaller-than-whole part of the region A (a region on the side of the wrinkle holding-down appliance 4) on the outer side of the region B to be contacted by the punch shoulder part 3 at the time of press forming is set to be the heated part and be softened. In a special case where one or more deeper-drawn shapes are partly present in the region C on the inner side of the region B to be contacted by the punch shoulder part 3 (refer to, for example, Example 4 described later and FIG. 6), it is effective, in obtaining a good formed product by press forming, that one or more regions with arbitrary shapes optimized correspondingly to the inner shape of the region C are added as heated parts.

According to the present invention, besides, it is possible to solve the problem of low bendability of the formed product, encountered in the related art in which enhancement of formability is contrived by applying a partial heating treatment to an alloy sheet blank having been aged at normal temperature. This problem is encountered with a panel which needs bending after press forming. Bending after press forming is, in many cases, applied to a part of the region A on the outer side of the region B to be contacted by the punch shoulder part. Utilizing this fact, the portion to be bent after press forming may be selectively added as a heated part, whereby the just-mentioned problem can be solved. Here, the reversion heating treatment has also the function to greatly enhance the bendability which has been considerably lowered due to normal-temperature aging. This is why the just-mentioned effect can be obtained.

Detailed Conditions for Partial Reversion Heating Treatment

As for the conditions of the partial reversion heating treatment, the partial reversion heating treatment includes the steps of heating said rolled sheet at a temperature rise rate of not less than 30° C./min to a temperature in the range of 150 to 350° C., holding the rolled sheet at a temperature in the range for a time of not more than 5 minutes (inclusive of a time of 0 second), and thereafter cooling the rolled sheet at a cooling rate of not less than 30° C./min to a temperature of 100° C. or below. The grounds for such specifications are as follows.

The above-mentioned lowering in strength by not less than 10 MPa at the heated part by the partial reversion heating treatment, in the case of the Al—Mg—Si based aluminum alloy, can be achieved by heating the alloy sheet at a temperature in the range of 150 to 350° C. for a time of up to 5 minutes.

In addition, in order that the strength difference between the heated part and the non-heated part be set to be not less than 10 MPa by the partial reversion heating treatment, a rapid temperature rise is needed; specifically, a temperature rise rate of not less than 30° C./min is needed. If the temperature rise rate is below 30° C./min, the percentage of lowering in strength owing to the restoration would be lowered, and, on the contrary, the percentage of increase in strength due to aging would be enhanced, with the result that it would be difficult to produce a strength difference between the heated part and the non-heated part. For the same reason, the temperature rise rate is preferably not less than 50° C./min, more preferably not less than 100° C./min.

Here, in the case where the reached heating temperature is below 150° C., the percentage of lowering in strength owing to the restoration is so low that it is difficult to produce a strength difference between the heated part and the non-heated part. On the other hand, if the reached heating temperature exceeds 350° C., intergranular precipitation would occur, leading to a lowered ductility.

The holding time at the reached temperature is within 5 minutes (inclusive of the case where the holding time is zero, i.e., the case where the alloy sheet is not made to stay at a predetermined temperature but is cooled immediately upon reaching the predetermined temperature). If the holding time at the reached temperature exceeds 5 minutes, the percentage of lowering in strength owing to the restoration would be lowered, and, on the contrary, the percentage of increase in strength due to aging would be enhanced, so that it would be difficult to lower the strength of the heated part, and productivity would be lowered.

Further, in the cooling process after the partial reversion heating treatment, the cooling down to 100° C. has also to be effected rapidly. Specifically, if the cooling rate to 100° C. is less than 30° C./min, intergranular precipitation would easily occur during the cooling, to lead to a lowering in ductility of the material. Therefore, the cooling rate is desirably not less than 30° C./min. For the same reason, the cooling rate is preferably not less than 50° C./min, more preferably not less than 100° C./min. In addition, if the material temperature after cooling is above 100° C., age hardening would take place, making it difficult to lower the strength of the heated part. Therefore, it is specified that the alloy sheet should be cooled to 100° C. or below after the partial reversion heating treatment.

On the other hand, as for the conditions of the partial reversion heating treatment for the purpose of ensuring that the difference between the tensile strength of the non-heated part at room temperature and the proof stress of the heated part at room temperature is increased by not less than 20 MPa through the partial reversion heating treatment, the partial reversion heating treatment includes the steps of heating the rolled sheet at a temperature rise rate of not less than 50° C./min to a temperature in the range of 180 to 350° C., holding the rolled sheet at a temperature in the range for a time of not more than 5 minutes (inclusive of a time of 0 second), and thereafter cooling the rolled sheet at a cooling rate of not less than 50° C./min to a temperature of 100° C. or below. The grounds for such specifications are as follows.

In order to ensure that the difference between the tensile strength of the non-heated part at room temperature and the proof stress of the heated part at room temperature is increased by not less than 20 MPa through the partial reversion heating treatment, the temperature of the region heated by the partial reversion heating treatment (namely, the heated part) is desirably set in the range of 180 to 350° C. Where the reached heating temperature is below 180° C., sufficient restoration is not achieved by a heating treatment carried out for such a short time as not to spoil productivity, as compared with the productivity in cold press forming; in this case, the material strength at the heated part is not lowered sufficiently. As a result, the difference between the tensile strength of the non-heated part at room temperature and the proof stress of the heated part at room temperature is not increased by not less than 20 MPa through the partial reversion heating treatment, and the enhancement of the formability of the alloy sheet by the partial reversion heating treatment is insufficient. On the other hand, if the reached heating temperature is above 350° C., fine precipitates composed of Mg and Si would be dissolved in solid solution in an extremely short time, immediately followed by formation of fine precipitates composed of Mg and Si, hence, aging, whereby the material would be hardened again. This aging takes place continually even during the subsequent cooling. Therefore, the lowering in the strength after the cooling is lessened. Further, since intergranular precipitation occurs simultaneously with the reversion phenomenon, elongation is considerably lowered, and cracking is liable to occur at the time of press forming; thus, formability is substantially not enhanced. On the contrary, where the reached heating temperature is in the range of 180 to 350° C., a strength difference can be effectively imparted to the alloy sheet blank, at such a high efficiency as not to spoil the productivity of press forming.

Here, the reached heating temperature in the partial reversion heating treatment can further be classified into two temperature ranges, according to the rate of variation in strength with time at the heated part.

In the case where the reached heating temperature is in the range of 250 to 350° C., fine precipitates composed of Mg and Si are dissolved in solid solution to complete restoration in a short time of several seconds, and, immediately upon cooling at a predetermined cooling rate to room temperature, the difference between the tensile strength of the non-heated part at room temperature and the proof stress of the heated part at room temperature has been increased by not less than 20 MPa through the partial reversion heating treatment. However, in the case where the reversion heating is carried out in this temperature range, a large number of vacancies (on an atomic level) are left at room temperature after cooling. The vacancies promote diffusion of Mg and Si during holding at room temperature in the part having undergone the partial reversion heating treatment, thereby accelerating the formation of the fine precipitates at room temperature. As a result, the proof stress value once lowered in this part would be rapidly returned to the level before the reversion heating treatment, during leaving of the alloy sheet at room temperature for several days. The density of the vacancies increases as the reached heating temperature is raised, and the increase in the density of vacancies accelerates the increase in the proof stress value at room temperature. Such a rapid change in strength distribution causes incompatibility with the press forming conditions optimized beforehand, leading to a higher possibility of defective shapes or defective appearances in the press formed products. Therefore, in order to stably manufacture acceptable formed products, it is desirable that the holding time at room temperature after the partial reversion heating treatment and before the press forming be set to be as short as possible. On the other hand, in the case where the reversion heating treatment is carried out in the temperature range of not lower than 180° C. and lower than 250° C., the restoration is completed in such a short time as not to spoil the productivity, as compared with the productivity of cold press forming. In addition, the density of vacancies at room temperature after cooling is sufficiently low, and the increase in proof stress value with time during the holding time at room temperature after the partial reversion heating treatment is sufficiently small. Therefore, where the partial reversion heating treatment is carried out in such a temperature range, acceptable formed articles can be stably manufactured even when the alloy sheet blank is held at room temperature for several days. Accordingly, in the case where the flexibility of schedule of production steps is of greater importance, the reached heating temperature in the partial reversion heating treatment is desirably set in the range of from 180° C., inclusive, to 250° C., exclusive so that the press forming can be carried out after holding the alloy sheet blank at room temperature for an appropriate time of several days after the partial reversion heating treatment. Here, in order to stably manufacture acceptable formed articles, the increase amount (increment) by which the proof stress value of the heated part heated in the partial reversion heating treatment is increased during the period of five days after the partial reversion heating treatment is set to be not more than 50 MPa, more preferably not more than 30 MPa.

In addition, the holding time at the reached temperature for ensuring that the difference between the tensile strength of the non-heated part at room temperature and the proof stress of the heated part at room temperature is increased by not less than 20 MPa through the partial restored heating temperature is desirably set to be up to 5 minutes (inclusive of the case where the holding time is zero, i.e., the case where the alloy sheet is substantially not held at the reached temperature but is cooled immediately on reaching that temperature). Similarly, in order to ensure that the difference between the tensile strength of the non-heated part at room temperature and the proof stress of the heated part at room temperature is increased by not less than 20 MPa through the partial reversion heating treatment, the temperature rise rate in the partial reversion heating treatment is desirably set to be not less than 50° C./min. If the temperature rise rate is less than 50° C./min, re-dissolution of the fine precipitates into solid solution due to restoration would proceeds during the temperature rise, and the restoration would be completed during the temperature rise or during the holding at the reached heating temperature, followed by precipitation so that strength would be increased. As a result, it is difficult to effectively reduce the proof stress of the heated part, and it is therefore difficult to ensure that the difference between the tensile strength of the non-heated part at room temperature and the proof stress of the heated part at room temperature is increased by not less than 20 MPa through the partial reversion heating treatment. Furthermore, the cooling rate of the heated part after the partial reversion heating treatment is desirably set to be not less than 50° C./min. If the cooling rate is less than 50° C./min, increase in strength due to aging would proceeds during cooling, making it difficult to effectively reduce the proof stress of the heated part. As a result, it is difficult to ensure that the difference between the tensile strength of the non-heated part at room temperature and the proof stress of the heated part at room temperature is increased by not less than 20 MPa through the partial reversion heating treatment.

Incidentally, the specific means for partially heating the alloy sheet blank as the partial reversion heating treatment is not particularly limited. Examples of the heating means include a method in which a heated metallic body is brought into contact with a sheet part corresponding to the held-down peripheral part at the time of press forming, and a method in which only the just-mentioned sheet part is heated by hot air.

Here, with the partial reversion heating treatment as above-described, the shape freeze performance of the formed product is enhanced owing to the lowering in the strength of the held-down peripheral part. In addition, the part lowered in strength owing to the reversion phenomenon is high in hardening rate at the time of baking of the coating thereon, and will recover its strength rapidly. Therefore, a high coating bake-hardenability (BH performance) can be obtained, and deterioration of strength after baking of the coating is obviated. This is because the baking of the coating after the clusters formed by normal-temperature aging are once dissolved in solid solution by the heating in the partial reversion heating treatment causes formation, in high density, of larger-sized precipitates which contribute more effectively to enhancement of strength. In contrast, when the baking of the coating is carried out in the condition where the clusters formed by normal-temperature aging are remaining, the clusters are once dissolved in solid solution at the reached heating temperature which is ordinarily below 180° C., and thereafter the formation of larger-sized precipitates which contribute more effectively to enhancement of strength begins. Therefore, where the work is held at the reached heating temperature for a short time of about 20 minutes for baking the coating, the extent of hardening is so low that a high coating bake-hardenability cannot be obtained. On the other hand, in the case of a formed product obtained through the partial reversion heating treatment according to the present invention, the proof stress of the heated part heated in the partial reversion heating treatment is enhanced by not less than 20 MPa by the coating-baking treatment (equivalent to an artificial aging) carried out within 30 days after the partial reversion heating treatment, so that the formed product can be provided with the rigidity required for use as a body panel.

Leaving to Stand at Normal Temperature from Partial Reversion Heating Treatment to Cold Press Forming The alloy sheet is left to stand at normal temperature after the partial reversion heating treatment until the cold press forming, and the normal-temperature leaving period is desirably set to be not more than 30 days. If the normal-temperature leaving period after the partial reversion treatment exceeds 30 days, the strength of the part once lowered in strength by heating and restoration may be raised by the new aging at normal temperature, and the strength difference between the heated part and the non-heated part of the alloy sheet may be reduced, making it impossible to obtain a high press formability. In order to securely restrain the new normal-temperature aging, it is desirable to set the normal-temperature leaving period to be preferably not more than 72 hours, more preferably not more than 24 hours, if possible, which is advantageous from the viewpoint of productivity also.

In addition, the period for which the alloy sheet is left to stand at normal temperature after the partial reversion heating treatment until the cold press forming is, more substantially, a period before the time when the strength of the part softened by the partial reversion heating treatment returns to the strength before the treatment. A further substantially preferable period is a period while the state in which the difference between the tensile strength of the non-heated part at room temperature and the proof stress of the heated part at room temperature has been increased by not less than 20 MPa is maintained after the partial reversion heating treatment. Incidentally, a lubricant applying step usually necessary for press forming is preferably carried out during the normal-temperature leaving period or immediately before the press forming.

Composition of Aluminum Alloy Sheet

The aluminum alloy sheet for forming in the present invention may basically be an Al—Mg—Si based alloy, and its specific composition is not particularly limited. Usually, the blank material is preferably an aluminum alloy containing 0.2 to 1.5% of Mg, and 0.3 to 2.0% of Si, and containing at least one selected from 0.03 to 1.0% of Fe, 0.03 to 0.6% of Mn, 0.01 to 0.4% of Cr, 0.01 to 0.4% of Zr, 0.01 to 0.4% of V, 0.005 to 0.3% of Ti, 0.03 to 2.5% of Zn, and 0.01 to 1.5% of Cu, with the balance being Al and unavoidable impurities.

The grounds for the limitations in regard of the composition of the blank material alloy will be described below.

Mg:

Mg is an alloying element which is fundamental to the alloy of the system in consideration in the present invention, and it cooperates with Si in contributing to enhancement of strength. When the Mg content is less than 0.2%, the amount of the β" phase contributing to enhancement of strength by precipitation hardening upon baking of the coating is so small that a sufficient strength enhancement cannot be obtained. On the other hand, when the Mg content exceeds 1.5%, a coarse Mg—Si based intermetallic compound is produced to lower formability, particularly, bendability. Taking these points into consideration, the Mg content has been set to within the range of 0.2 to 1.5%. In order to obtain better formability, particularly, better bendability of the final alloy sheet, the Mg content is preferably in the range of 0.3 to 0.9%.

Si:

Si is also an alloying element fundamental to the alloy of the system in consideration in the present invention, and it cooperates with Mg in contributing to enhancement of strength. Besides, Si is formed as a crystallized product of metallic Si upon casting, and the peripheries of the metallic Si particles are deformed upon working, to be sites of formation of recrystallization nuclei upon a solution treatment (solutionizing treatment). Therefore, Si contributes also to refining of the recrystallized texture. When the Si content is less than 0.3%, the above-mentioned effects cannot be obtained sufficiently. On the other hand, when the Si content exceeds 2.0%, coarse Si particles and/or a coarse Mg—Si based intermetallic compound is produced to lower formability, particularly, bendability. Taking these points into account, the Si content has been set to within 0.3 to 2.0%. In order to obtain better balance between press formability and bendability, the Si content is preferably in the range of 0.5 to 1.4%.

While Mg and Si are alloying elements fundamental to the Al—Mg—Si based aluminum alloy, the alloy further contains at least one selected from among 0.03 to 1.0% of Fe, 0.03 to 0.6% of Mn, 0.01 to 0.4% of Cr, 0.01 to 0.41 of Zr, 0.01 to 0.4% of V, 0.005 to 0.3% of Ti, 0.03 to 2.5% of Zn, and 0.01 to 1.5% of Cu. The reasons for addition of these elements and the grounds for limitations of the amounts of the elements added are as follows.

Ti, V:

Ti is an element effective in enhancing strength through refining of the ingot texture and in preventing corrosion, and V is an element effective in enhancing strength and in preventing corrosion. When the Ti content is less than 0.005%, sufficient effects cannot be obtained. On the other hand, when the Ti content exceeds 0.3%, the ingot texture refining effect and the corrosion preventive effect of the addition of Ti are saturated. When the V content is less than 0.01%, sufficient effects cannot be obtained. On the other hand, when the V content exceeds 0.4%, the corrosion preventive effect of the V addition is saturated. Further, when each of the upper limits is exceeded, the amounts of coarse intermetallic compounds based on Ti or V are increased, leading to lowered formability and/or lowered hemmability.

Mn, Cr, Zr:

These elements are effective in enhancing strength, in refining crystal grains, or in enhancing ageability (bake hardenability). When the Mn content is less than 0.03% or the Cr and Zr contents are less than 0.01%, respectively, the just-mentioned effects cannot be obtained satisfactorily. On the other hand, when the Mn content exceeds 0.6% or the Cr and Zr contents exceed 0.4%, respectively, not only the just-mentioned effects are saturated but also many kinds of intermetallic compounds are formed to adversely affect formability, particularly, hem-bendability. Therefore, the Mn content has been set to within the range of 0.03 to 0.6%, and the Cr and Zr contents have been set to within the range of 0.01 to 0.4%, respectively.

Fe:

Fe is usually contained in ordinary aluminum alloys in a content of less than 0.03% as an unavoidable impurity. On the other hand, Fe is an element effective in enhancing strength and in refining crystal grains. In order to make these effects exhibited, Fe may be positively added in an amount of not less than 0.03%. It is to be noted, however, sufficient effects cannot be obtained the Fe content is less than 0.03%. On the other hand, an Fe content in excess of 1.0% may lower formability, particularly, bendability. Therefore, the Fe content in the case of positive addition of Fe has been set to within the range of 0.03 to 1.0%.

Zn:

Zn is an element which contributes to enhancement of strength through enhancing ageability and which is effective in enhancing surface treatability. When the Zn content is less than 0.03%, the just-mentioned effects cannot be obtained satisfactorily. On the other hand, a Zn content in excess of 2.5% leads to lowered formability and lowered corrosion resistance. Therefore, the Zn content has been set to within 0.03 to 2.5%.

Cu:

Cu is an element added for enhancing formability and strength. For the purpose of enhancing formability and strength, Cu is added in an amount of not less than 0.01%. However, when the Cu content exceeds 1.5%, corrosion resistance (intergranular corrosion resistance, filiform corrosion resistance) is deteriorated. Therefore, the Cu content has been restricted to 1.5% or below. Incidentally, where enhancement of strength is of great importance, the Cu content is preferably not less than 0.4%. Besides, where it is intended to improve corrosion resistance, the Cu content is preferably not more than 1.0%. Furthermore, where corrosion resistance is of great importance, Cu is not added positively, and the Cu content is preferably restricted to 0.01% or below.

Besides, in ordinary Al alloys, B (boron) may be added together with Ti for the purpose of refining the ingot texture. Addition of B together with Ti leads to a more conspicuous effect to refine and stabilize the ingot texture. In the present invention, up to 500 ppm of B may be added together with Ti.

EXAMPLES

Now, Examples of the present invention will be described below, together with Comparative Examples. Incidentally, the following Examples are for describing the effects of the present invention, and the processes and conditions described in the Examples are not to be construed as limitative of the technical scope of the invention.

Example 1

Aluminum alloys A1 to A6 as shown in Table 1 were melted and adjusted in composition, and the melts were cast by the DC casting process, to produce aluminum alloy ingots. Each of the ingots was soaked at 530° C. for 10 hours, and was then subjected to hot rolling and cold rolling according to the ordinary methods, to obtain a 1 mm-thick alloy sheet. Each of the alloy sheets thus obtained was then subjected to a solution treatment at 530° C., followed by rapid cooling to room temperature. After the solution treatment and the rapid cooling, each alloy sheet was left to stand at room temperature for 60 days. Thereafter, the portion, to be the held-down peripheral part at the time of drawing, of each alloy sheet was subjected to a partial reversion heating treatment under the heating conditions shown in Table 2. After each alloy sheet as a whole was cooled to normal temperature, the alloy sheet was served to measurement of strength (tensile strength and 0.2% proof stress) of the non-heated part and the heated part, limit drawing ratio (LDR), and coating baked strength of the heated part, in a normal-temperature leaving period of 24 hours. Further, the hemmability of the heated part was evaluated in a normal-temperature leaving period of 24 hours.

LDR (Limit Drawing Ratio) Test:

The alloy sheets were subjected to drawing under the condition of a punch diameter (P) of 32 mmϕ, a wrinkle holding-down force of 150 kg, and a blank diameter changed variously, and LDR values of the alloy sheets were calculated by the formula: LDR=D/P, where D is the maximum drawable blank diameter. The drawing was carried out by applying Johnson Wax (trademark) as a lubricant to both sides of each alloy sheet.

Coating Baked Strength:

For each of the alloy sheets, a JIS No. 5 test specimen was subjected to 2% stretching, was then subjected to a coating baking treatment at 170° C. for 20 minutes, and was served to a tensile test. In the tensile test, 0.2% proof stress was measured as mechanical strength.

Evaluation of Hemmability:

For each of the alloy sheets, a bending test specimen was subjected to 5% stretching, and was subjected to 1800 contact bending. Upon the bending, the presence/absence of crack(s) was visually checked. Here, symbol ○ represents the absence of crack(s), and symbol X represents the presence of crack(s).

TABLE 1

| Alloy symbol | Alloy composition (mass %) | | | | | | | | | | |
|---|---|---|---|---|---|---|---|---|---|---|---|
| | Mg | Si | Fe | Cu | Mn | Cr | Zr | V | Zn | Ti | Al |
| A1 | 0.69 | 0.75 | 0.25 | — | 0.11 | — | — | — | — | 0.02 | balance |
| A2 | 0.55 | 1.05 | 0.18 | — | 0.05 | 0.04 | — | — | — | 0.02 | balance |
| A3 | 0.42 | 1.52 | 0.54 | 0.51 | 0.35 | — | — | — | 0.12 | 0.12 | balance |
| A4 | 0.45 | 1.11 | 0.15 | 0.74 | 0.12 | — | — | — | — | 0.12 | balance |
| A5 | 0.35 | 0.85 | 0.12 | 0.93 | 0.09 | 0.03 | 0.11 | 0.05 | 0.22 | 0.01 | balance |
| A6 | 0.51 | 1.08 | 0.17 | 0.03 | 0.13 | 0.05 | — | — | — | 0.01 | balance |

The alloys A1 to A6 shown in Table 1 are all within the composition ranges of the present invention.

TABLE 2

| | | Heating Treatment (Partial reversion treatment conditions) | | | | Performance | | | |
|---|---|---|---|---|---|---|---|---|---|
| Tested specimen No. | Alloy symbol | Temperature rise rate (° C./min) | Reached heating temperature (° C.) | Holding time (sec) | Cooling rate (° C./min) | Strength difference[1)] (MPa) | Limit drawing ratio LDR | Hemmability (visual inspection) | 0.2% Proof stress[2)] (MPa) |
| 1 | A1 | 200 | 200 | 10 | 150 | 12 | 2.09 | ○ | 168 |
| 2 | A2 | 500 | 230 | 5 | 500 | 34 | 2.19 | ○ | 220 |
| 3 | A3 | 500 | 250 | 2 | 500 | 55 | 2.25 | ○ | 233 |
| 4 | A4 | 1000 | 280 | 0 | 500 | 61 | 2.31 | ○ | 241 |
| 5 | A6 | 800 | 300 | 0 | 800 | 54 | 2.24 | ○ | 224 |
| 6 | A5 | 200 | 100 | 60 | 70 | −5 | 1.96 | ○ | 161 |
| 7 | A5 | 10 | 160 | 400 | 100 | −15 | 1.91 | X | 177 |
| 8 | A2 | 60 | 200 | 200 | 2 | −22 | 1.89 | X | 200 |
| 9 | A1 | — | — | — | — | — | 2.01 | ○ | 157 |

Note:

[1)]Difference in strength (difference in 0.2% proof stress) between the non-heated part and the heated part.

[2)]0.2% proof stress after baking of the coating.

All of Tested Specimen Nos. 1 to 5 shown in Table 2 belong to Examples of the present invention, whereas Tested Specimen Nos. 6 to 9 belong to Comparative Examples.

All the specimens of Examples satisfied the condition that the difference in strength (difference in 0.2% proof stress) between the non-heated part and the heated part are not less than +12 MPa; in addition, they not only had high LDR values of not less than 2.09 but also were good in hemmability and high in strength after baking of the coating.

On the other hand, the specimens of Comparative Examples were poor in performance, particularly in LDR. Of these specimens, Tested Specimen Nos. 6, 7 and 8 had the following problems, since the heating conditions of the partial reversion heating treatment applied to them were outside the ranges according to the present invention. These specimens had a high strength at the heated part and a low strength at the non-heated part, contrary to the cases of the specimens of Examples of the invention. Thus, in Tested Specimen Nos. 6 to 8, the held-down peripheral part was high, whereas the punch shoulder part contact part was low in strength, so that LDR was lowered considerably. Further, Tested Specimen Nos. 7 and 8 were deteriorated also in hemmability. Tested Specimen No. 9 belonging to Comparative Example is a specimen obtained by cold pressing an alloy sheet which had not been subjected to the partial reversion heating treatment and was therefore uniform in strength. Tested Specimen No. 9 was inferior in LDR and in strength after baking of the coating, as compared with Tested Specimen No. 1 belonging to Example of the invention and having the same alloy composition as that of Tested Specimen No. 9.

Example 2

On a process basis, Example 2 is primarily for demonstrating the effects of the methods as set forth in the present invention.

Aluminum alloys B1 to B3 as shown in Table 3 were melted, and the melts were cast by the DC casting process, to produce aluminum alloy ingots with the chemical compositions as shown in Table 3. Each of the ingots was soaked at 530° C. for 10 hours, and was then subjected to hot rolling and cold rolling according to the ordinary methods, to obtain a 1 mm-thick alloy sheet. Each of the alloy sheets thus obtained was then subjected to a solution treatment at 530° C., followed by rapid cooling to room temperature.

Thereafter, the alloy sheets were subjected to a normal-temperature aging (NTA) or artificial aging (AA) or an aging treatment obtained by a combination of the two kinds of aging (NTA and AA), in the conditions as shown in Tables 4 and 5. From the alloy sheets thus treated, tensile test specimens (JIS No. 5 test specimen shape) were sampled so that the tensile direction would be perpendicular to the rolling direction. The tensile test specimens were served to tensile tests to examine their mechanical properties (tensile strength, proof stress, and elongation), the results being shown in Tables 4 and 5. In addition, each of the alloy sheets was subjected to a partial reversion heating treatment according to a method described below, and was then served to a formability evaluation test.

Figure 2:
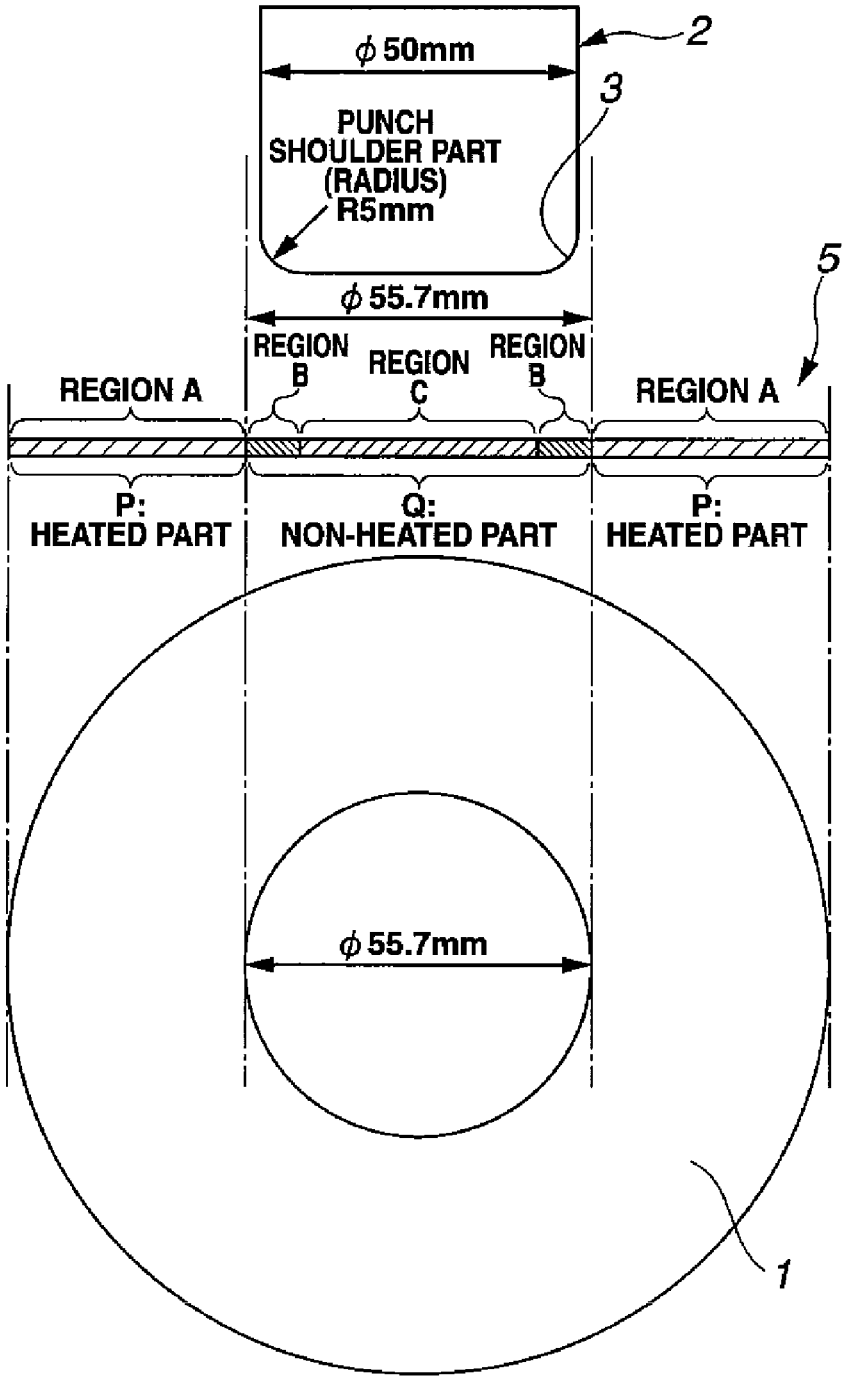
FIG. 2 is a schematic view for showing a heated part and a non-heated part at the time of a partial reversion heating treatment in Example 2.
Figure 3:
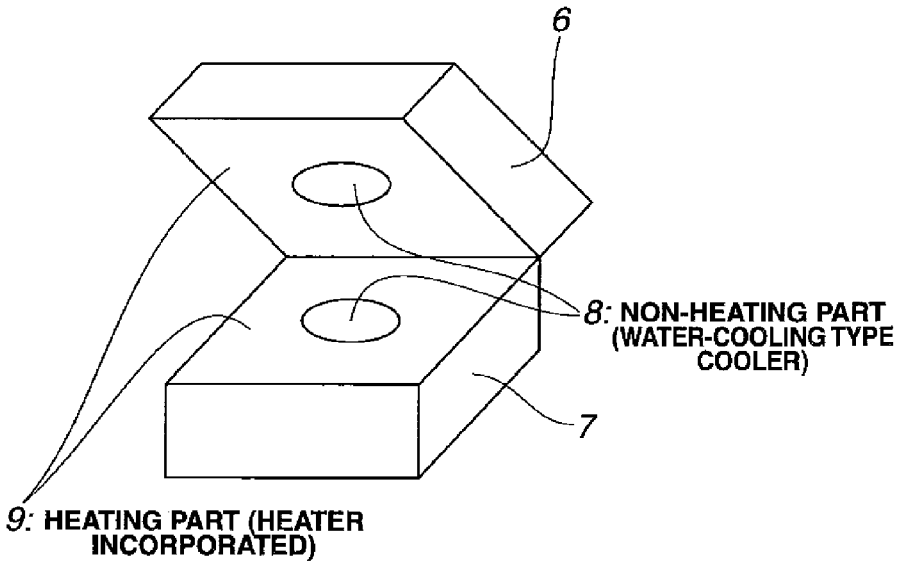
FIG. 3 is a schematic perspective view of a partial reversion heating treatment system used in Example 2.

First, from each alloy sheet, a circular disk blank with a predetermined size for evaluation of formability was prepared. As shown in FIG. 2, the region of a 55.7 mmϕ central part of the disk sample (blank 5) was set to be a non-heated part (a part not to be heated) Q, while the peripheral region thereof was set to be a heated part (a part to be heated) P, and, under this setting, the disk blank 5 was subjected to a partial reversion heating treatment. The heated part is the whole part of the portion on the outer side of the region to be contacted by a shoulder part (radius) 3 of a punch 2 at the time of press forming. As for a specific method for carrying out the partial reversion heating treatment, the treatment was conducted in the condition where the disk blank 5 was clamped between an upper plate 6 and a lower plate 7 of a partial reversion heating treatment system shaped as schematically illustrated in FIG. 3. In FIG. 3, of each of the upper plate 6 and the lower plate 7, a central part was set to be a non-heating part 8 cooled by water cooling, and the surrounding part was set to be a heating part 9 with a heater incorporated therein. The conditions such as the reached heating temperature, the heating time (the holding time in heating), the temperature rise rate and the cooling rate, at the heating part in the partial reversion heating treatment are shown in Tables 4 and 5.

Figure 4:
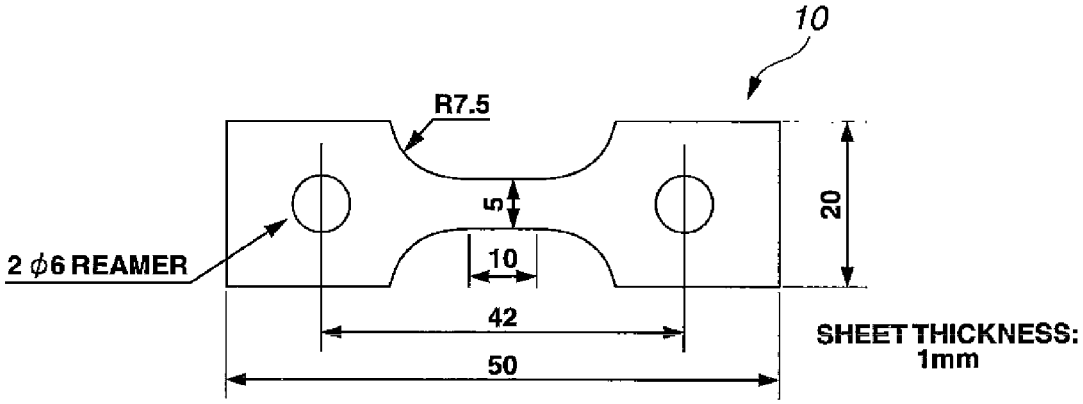
FIG. 4 is a plan view showing the shape and dimensions of a tensile test piece sampled in Example 2.
Figure 5:
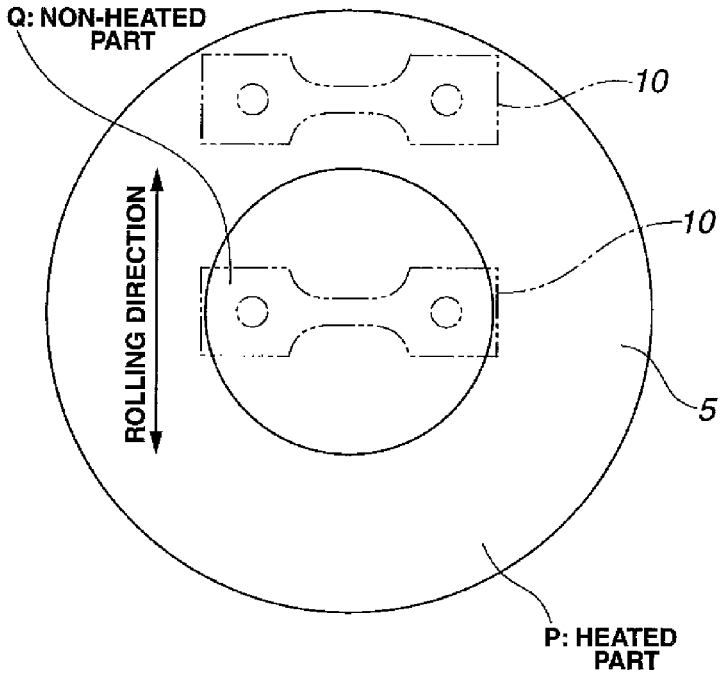
FIG. 5 is a plan view showing the positions where tensile test pieces were sampled from a heated part and a non-heated part of a blank subjected to the partial reversion heating treatment in Example 2.

The disk blanks subjected to the partial reversion heating treatment under these conditions were served to a formability evaluation test described below. In addition, for each of the disk blanks corresponding to the conditions, small-sized tensile test specimens 10 shown in FIG. 4 were sampled respectively from both the heated part P and the non-heated part Q (the positions of sampling are shown in FIG. 5), and were served to a tensile test so as to examine the proof stresses at the non-heated part Q and the heated part P, the results being shown in Tables 6 and 7. The evaluation of strength at the portions (P, Q) after the partial reversion heating treatment was conducted as immediately as possible after the partial reversion heating treatment, substantially within 5 hours after the partial reversion heating treatment. Besides, in order to determine the time change (variation with time) of the proof stress at the heated part of each of the disk blanks having undergone the partial reversion heating treatment under the above-mentioned conditions, tensile test specimens were similarly sampled from the heated parts of the disk blanks after 1 day and after 5 days from the completion of the partial reversion heating treatment, and the test specimens were served to a tensile test immediately upon the sampling, so as to examine the proof stress values after the lapse of the respective periods of time, the results being shown in Tables 6 and 7. Further, after the partial reversion heating treatment was over, the disk blanks were held at room temperature for the same period as the period until the execution of the formability evaluation test, and thereafter small-sized tensile test specimens were sampled from both the heated part and the non-heated part (the positions of sampling are shown in FIG. 5). These test specimens were preliminarily given a 2% deformation as a simulation of press forming, and were then subjected to artificial aging at 170° C. for 20 minutes, the condition corresponding to a coating baking treatment. The thus treated test specimens were served to a tensile test to measure the proof stress at the respective portions, and the increases in the proof stress at the respective portions due to the heat treatment equivalent to a coating baking treatment are shown in Tables 6 and 7. In addition, after the partial reversion heating treatment was over, the disk blanks were held at room temperature for a period equal to the period until the formability evaluation test plus 3 days, and then small-sized tensile test specimens were sampled from the heated parts of the disk blanks. After a 5% tensile deformation was applied to these tensile test specimens, a parallel portion of each of the test specimens was cut off, and was served to a bendability evaluation test according to the following method. First, a line orthogonal to the tensile direction located at a central part of the parallel portion of each test specimen was set to be a bending line, and, at this bending line, the parallel portion was bent with a radius of bending of 0.8 mm until an angle of 90° is reached. Further, the parallel portion was bent to an angle of 135°. Then, assuming the insertion of an inner panel into the inside, a 1.0 mm-thick strip was inserted into the inside of the bent parallel portion, and the parallel portion was bend to an angle of 180° so as to sandwich the strip, resulting in firm contact of the sheet-like portions. The outside of the bent part was visually inspected through a magnifying lens, and the tested parallel portion of the test specimen was evaluated as good or bad in bendability according to the presence or absence of crack(s).

As for the formability evaluation test, the disk blanks having undergone the partial reversion heating treatment were held at room temperature for the periods of time shown in Tables 6 and 7, and were then served to a cylinder deep drawing test. The punch used in this test had such a shape as to have a punch diameter of 50 mm and a punch corner radius of 5.0 mm. The die used in the test had such a shape as to have a die inner diameter of 53.64 mm and a die shoulder radius of 13.0 mm. The deep drawing test was conducted under the conditions of a punch speed of 180 mm/min, and a wrinkle holding-down force of 150 kg, while using Johnson Wax (trademark) as a lubricant. The alloy sheet blanks having undergone the partial reversion heating treatment were served to the deep drawing test. When three sheet blanks out of five sheet blanks of the same type were drawable, the disk diameter was increased by 0.5 mm to prepare new blank specimens, and the deep drawing test was again conducted using the new blank specimens. This procedure was repeated, to determine the maximum disk diameter permitting drawing, and the maximum disk diameter was divided by the punch diameter of 50 mm, to obtain a limit drawing ratio LDR. In addition, for comparison, the LDR was determined also for disk blanks prepared from alloy sheets not having undergone the partial reversion heating treatment. The results of the cylinder deep drawing test are shown in Table 5. Here, it is judged that the formability was substantially enhanced by the partial reversion heating treatment, in the case where the LDR value obtained with the partial reversion heating treatment showed an increase by 0.1 as compared to the LDR value obtained without the partial reversion heating treatment.

TABLE 3

| Alloy | Alloy composition (mass %) | | | | | | | | | | |
|---|---|---|---|---|---|---|---|---|---|---|---|
| symbol | Mg | Si | Fe | Cu | Mn | Cr | Zr | V | Zn | Ti | Al |
| B1 | 0.65 | 1.05 | 0.18 | — | 0.10 | 0.03 | — | — | — | 0.01 | balance |
| B2 | 0.49 | 1.30 | 0.21 | 0.82 | — | — | 0.05 | 0.03 | 0.06 | — | balance |
| B3 | 0.05 | 1.20 | 0.10 | 0.03 | 0.24 | 0.06 | 0.02 | — | — | 0.01 | balance |

TABLE 4

| | | Conditions | Mechanical properties after aging and before partial reversion treatment | | | Conditions of partial reversion heating treatment | | | | Holding time until | |
|---|---|---|---|---|---|---|---|---|---|---|---|
| Condition No. | Alloy symbol | of aging after solution treatment[1)] | Tensile strength (MPa) | Proof stress (MPa) | Elongation (%) | Heating temperature (° C.) | Holding time in heating (sec) | Temperature rise rate (° C./min) | Cooling rate (° C./min) | deep drawing[2)] (days) | Classification |
| 1 | B1 | NTA (25° C. × 60 days) | 250 | 132 | 30 | 180 | 240 | 300 | 100 | 3 | 2nd Example |
| 2 | | | | | | 230 | 20 | 4000 | 1000 | 3 | 2nd Example |
| 3 | | | | | | 280 | 3 | 400 | 250 | 1 | 2nd Example |
| 4 | | | | | | 330 | 1 | 3000 | 2000 | 1 | 2nd Example |
| 5 | | | | | | 160 | 100 | 200 | 100 | 1 | 1st Example |
| 6 | | | | | | 360 | 3 | 4000 | 2000 | 1 | Comparative Example |
| 7 | | | | | | 240 | 3 | 30 | 200 | 1 | 1st Example |
| 8 | | | | | | 245 | 3 | 300 | 30 | 1 | 1st Example |
| 9 | B1 | NTA (25° C. × 1 day) + AA (80° C. × 10 hr) + NTA (30° C. × 10 days) | 248 | 129 | 31 | 240 | 5 | 500 | 400 | 3 | 2nd Example |
| 10 | B1 | AA (50° C. × 1 day) + NTA (25° C. × 50 days) | 265 | 145 | 30 | 245 | 5 | 1000 | 1000 | 1 | 2nd Example |

TABLE 4-continued

| Condition No. | Alloy symbol | Conditions of aging after solution treatment[1)] | Mechanical properties after aging and before partial reversion treatment: Tensile strength (MPa) | Proof stress (MPa) | Elongation (%) | Conditions of partial reversion heating treatment: Heating temperature (° C.) | Holding time in heating (sec) | Temperature rise rate (° C./min) | Cooling rate (° C./min) | Holding time until deep drawing[2)] (days) | Classification |
|---|---|---|---|---|---|---|---|---|---|---|---|
| 11 | B1 | NTA (25° C. × 0.5 day) | 198 | 88 | 31 | 250 | 5 | 200 | 200 | 3 | Comparative Example |

Notes:
[1)]NTA = Normal-temperature aging, AA = Artificial aging.
[2)]Holding time after partial reversion heating treatment until deep drawing

TABLE 5

| Condition No. | Alloy symbol | Conditions of aging after solution treatment[1)] | Mechanical properties after aging and before partial reversion treatment: Tensile strength (MPa) | Proof stress (MPa) | Elongation (%) | Conditions of partial reversion heating treatment: Heating temperature (° C.) | Holding time in heating (sec) | Temperature rise rate (° C./min) | Cooling rate (° C./min) | Holding time until deep drawing[2)] (days) | Classification |
|---|---|---|---|---|---|---|---|---|---|---|---|
| 12 | B2 | AA (55° C. × 20 hr) → NTA (25° C. × 90 days) | 304 | 152 | 32 | 180 | 240 | 200 | 200 | 3 | 2nd Example |
| 13 | | | | | | 200 | 150 | 200 | 200 | 3 | 2nd Example |
| 14 | | | | | | 230 | 30 | 4000 | 1000 | 3 | 2nd Example |
| 15 | | | | | | 260 | 3 | 3000 | 1200 | 1 | 2nd Example |
| 16 | | | | | | 160 | 300 | 200 | 200 | 1 | 1st Example |
| 17 | | | | | | 360 | 2 | 4000 | 1000 | 1 | Comparative Example |
| 18 | | | | | | 380 | 1 | 1500 | 1500 | 1 | Comparative Example |
| 19 | | | | | | 220 | 400 | 200 | 200 | 1 | Comparative Example |
| 20 | B2 | NTA (25° C. × 0.5 day) | 223 | 86 | 33 | 230 | 10 | 200 | 200 | 1 | Comparative Example |
| 21 | B3 | NTA (15° C. × 30 days) | 246 | 142 | 32 | 245 | 0 | 500 | 500 | 10 | 2nd Example |
| 22 | B3 | AA (70° C. × 1 day) | 258 | 153 | 30 | 230 | 2 | 200 | 400 | 3 | 2nd Example |

Notes:
[1)]NTA = Normal-temperature aging, AA = Artificial aging.
[2)]Holding time after partial reversion heating treatment until deep drawing.

TABLE 6

| Condition No. | Strength just on partial reversion heating treatment: Tensile strength non-heated part (MPa) | Proof stress, heated part (MPa) | Difference between tensile strength of non-heated part and proof stress of heated part: Before partial reversion treatment (MPa) | After partial reversion treatment (MPa) | Increase through partial reversion treatment (MPa) | Time change in proof stress of heated part after partial reversion heating treatment: Proof stress, after 1 day (MPa) | Proof stress, after 5 days (MPa) |
|---|---|---|---|---|---|---|---|
| 1 | 250 | 105 | 118 | 145 | 27 | 105 | 106 |
| 2 | 246 | 95 | 118 | 151 | 33 | 97 | 100 |

TABLE 6-continued

| | | | | | | | |
|---|---|---|---|---|---|---|---|
| 3 | 243 | 90 | 118 | 153 | 35 | 93 | 108 |
| 4 | 240 | 89 | 118 | 151 | 33 | 92 | 121 |
| 5 | 250 | 120 | 118 | 130 | 12 | 120 | 120 |
| 6 | 246 | 125 | 118 | 121 | 3 | 126 | 128 |
| 7 | 246 | 116 | 118 | 130 | 12 | 118 | 122 |
| 8 | 245 | 113 | 118 | 132 | 14 | 115 | 120 |
| 9 | 246 | 95 | 119 | 151 | 32 | 96 | 98 |
| 10 | 260 | 82 | 120 | 178 | 58 | 86 | 93 |
| 11 | 198 | 84 | 110 | 114 | 4 | 84 | 85 |

| | Time change in proof stress of heated part after partial reversion heating treatment Proof stress increase, | Limit drawing ratio LDR | | | Increase in proof stress[3)] | | |
|---|---|---|---|---|---|---|---|
| Condition No. | 5 days after treatment (MPa) | untreated material[1)] | Treated material[2)] | Bendability | Non-heated part (MPa) | Heated part (MPa) | Classification |
| 1 | 1 | 2.01 | 2.20 | good | 43 | 93 | 2nd Example |
| 2 | 5 | 2.01 | 2.26 | good | 44 | 95 | 2nd Example |
| 3 | 18 | 2.01 | 2.27 | good | 45 | 56 | 2nd Example |
| 4 | 32 | 2.01 | 2.28 | good | 44 | 43 | 2nd Example |
| 5 | 0 | 2.01 | 2.09 | good | 45 | 48 | 1st Example |
| 6 | 3 | 2.01 | 1.98 | bad | 44 | 15 | Comparative Example |
| 7 | 6 | 2.01 | 2.07 | good | 44 | 43 | 1st Example |
| 8 | 7 | 2.01 | 2.08 | good | 44 | 42 | 1st Example |
| 9 | 3 | 2.02 | 2.26 | good | 42 | 94 | 2nd Example |
| 10 | 11 | 2.01 | 2.45 | good | 40 | 102 | 2nd Example |
| 11 | 1 | 2.03 | 2.08 | good | 45 | 43 | Comparative Example |

Notes:

[1)]Material not subjected to the partial reversion heating treatment.

[2)]Material subjected to the partial reversion heating treatment.

[3)]Increase in proof stress by 170° C. × 20 min artificial aging after 2% deformation.

TABLE 7

| | Strength just on partial reversion heating treatment | | Difference between tensile strength of non-heated part and proof stress of heated part | | | Time change in proof stress of heated part after partial reversion heating treatment | |
|---|---|---|---|---|---|---|---|
| Condition No. | Tensile strength non-heated part (MPa) | Proof stress, heated part (MPa) | Before partial reversion treatment (MPa) | After partial reversion treatment (MPa) | Increase through partial reversion treatment (MPa) | Proof stress, after 1 day (MPa) | Proof stress, after 5 days (MPa) |
| 12 | 304 | 108 | 152 | 196 | 44 | 108 | 108 |
| 13 | 298 | 90 | 152 | 208 | 56 | 103 | 105 |
| 14 | 296 | 99 | 152 | 197 | 45 | 102 | 105 |
| 15 | 296 | 95 | 152 | 201 | 49 | 105 | 128 |
| 16 | 304 | 141 | 152 | 163 | 11 | 141 | 141 |
| 17 | 292 | 140 | 152 | 152 | 0 | 156 | 159 |
| 18 | 290 | 153 | 152 | 147 | −5 | 158 | 163 |
| 19 | 295 | 146 | 152 | 149 | −3 | 146 | 148 |
| 20 | 220 | 80 | 137 | 140 | 3 | 81 | 83 |
| 21 | 244 | 104 | 104 | 140 | 36 | 109 | 114 |
| 22 | 253 | 112 | 102 | 141 | 39 | 115 | 120 |

TABLE 7-continued

| Condition No. | Time change in proof stress of heated part after partial reversion heating treatment Proof stress increase, 5 days after treatment (MPa) | Limit drawing ratio LDR untreated material[1)] | Limit drawing ratio LDR Treated material[2)] | Bendability | Increase in proof stress[3)] Non-heated part (MPa) | Increase in proof stress[3)] Heated part (MPa) | Classification |
|---|---|---|---|---|---|---|---|
| 12 | 0 | 2.03 | 2.30 | good | 42 | 96 | 2nd Example |
| 13 | 15 | 2.03 | 2.50 | good | 42 | 102 | 2nd Example |
| 14 | 6 | 2.03 | 2.31 | good | 43 | 65 | 2nd Example |
| 15 | 33 | 2.03 | 2.28 | good | 43 | 53 | 2nd Example |
| 16 | 0 | 2.03 | 2.10 | good | 43 | 48 | 1st Example |
| 17 | 19 | 2.03 | 2.03 | bad | 41 | 13 | Comparative Example |
| 18 | 10 | 2.03 | 2.02 | bad | 42 | 9 | Comparative Example |
| 19 | 2 | 2.03 | 2.02 | bad | 42 | 25 | Comparative Example |
| 20 | 3 | 2.04 | 2.04 | good | 43 | 53 | Comparative Example |
| 21 | 10 | 2.02 | 2.25 | good | 42 | 79 | 2nd Example |
| 22 | 8 | 2.02 | 2.26 | good | 44 | 74 | 2nd Example |

Notes:
[1)]Material not subjected to the partial reversion heating treatment.
[2)]Material subjected to the partial reversion heating treatment.
[3)]Increase in proof stress by 170° C. × 20 min artificial aging after 2% deformation.

Conditions 1 to 4 are examples in which the alloy B1 was subjected to the partial reversion heating treatment and/or the like under the conditions within the ranges of the present invention (2nd Example). In each of these cases, the difference between the tensile strength of the non-heated part at room temperature and the proof stress of the heated part at room temperature was increased by not less than 20 MPa through the partial reversion heating treatment. In addition, also in the formability evaluation test, the LDR value showed an increase by not less than 0.1 as compared with the LDR value obtained without the partial reversion heating; thus, a formability-enhancing effect effective on a practical-use basis was recognized. Besides, it was confirmed that an increase in proof stress by not less than 20 MPa was observed at the heated part after the heat treatment equivalent to a coating baking treatment, whereby it was proved that a strength level necessary for automobile body sheets can be secured. Further, the time change (variation with time) of the proof stress at the heated part after the partial reversion heating treatment was moderate, and the increase in the proof stress during the period of 5 days after the partial reversion heating treatment was stable at not more than 50 MPa. From this fact, it was confirmed that acceptable formed articles free of defective shape or defective appearance can be stably manufactured by press forming. Further, it was proved that the bendability of the heated part heated in the partial reversion heating treatment is good, and, when the bent part of the final press formed product is preliminarily set to be the heated part, bending can be performed easily.

On the other hand, Condition 5 is an example in which the reached heating temperature in the partial reversion heating treatment is below the temperature range of the present invention for ensuring that the difference between the tensile strength of the non-heated part at room temperature and the proof stress of the heated part at room temperature is increased by not less than 20 MPa by the partial reversion heating treatment (1st Example). In this case, a sufficient softening effect of the restoration was not obtainable at the heated part, and the above-mentioned increase was less than 20 MPa. Therefore, it was found that the LDR value obtained upon the formability evaluation test did not show a sufficient improvement as compared with the LDR value obtained without the partial reversion heating treatment.

In addition, Condition 6 is Comparative Example in which the reached heating temperature in the partial reversion heating treatment is above the temperature range according to the present invention. In this case, age precipitation proceeds immediately upon completion of the restoration in a short time at the heated part, whereby the proof stress of the heated part is raised undesiredly. As a result, the difference between the tensile strength of the non-heated part at room temperature and the proof stress of the heated part at room temperature is increased by only less than 20 MPa through the partial reversion heating treatment. Therefore, the LDR value obtained upon the formability evaluation test is comparable to the LDR value obtained without the partial reversion heating treatment, showing that formability is not enhanced. Further, intergranular precipitation is induced by the heating at this reached heating temperature, so that bendability is lowered largely.

Thus, it was found that the bending of the formed article cannot be conducted. Besides, in this case, the increase in the proof stress by the post-forming artificial aging at the heated part is less than 20 MPa. Thus, strength necessary for body panels could not be secured.

Besides, Condition 7 is an example in which the temperature rise rate in the partial reversion heating is below the temperature rise rate of the present invention for ensuring that the difference between the tensile strength of the non-heated part at room temperature and the proof stress of the heated part at room temperature is increased by not less than 20 MPa by the partial reversion heating treatment (1st Example). In this case, in the course of the slow temperature rise and in the course of the holding at the reached heating temperature, age precipitation would undesiredly proceed subsequently to the restoration in the heated part. As a result, the difference between the tensile strength of the non-heated part at room temperature and the proof stress of the heated part at room temperature was increased by only less than 20 MPa through the partial reversion heating treatment. Therefore, an LDR improvement by not less than 0.1 was not observed, and a sufficient formability-enhancing effect of the partial reversion heating treatment was not recognized.

Further, Condition 8 is an example in which the cooling rate in the partial reversion heating treatment is under the cooling rate of the present invention for ensuring that the difference between the tensile strength of the non-heated part at room temperature and the proof stress of the heated part at room temperature is increased by not less than 20 MPa by the partial reversion heating treatment (1st Example). In this case, though the heated part is once softened by restoration, it is again hardened due to the progress of age precipitation in the course of the slow cooling after the heating. As a result of this phenomenon, the difference between the tensile strength of the non-heated part at room temperature and the proof stress of the heated part at room temperature is increased by only less than 20 MPa by the partial reversion heating treatment. Therefore, a sufficient LDR improvement by not less than 0.1 was not observed, and a sufficient formability-enhancing effect of the partial reversion heating treatment was not recognized.

In addition, Conditions 9 and 10 are examples in which the partial reversion heating treatment and the like are conducted in the conditions within the ranges after an aging treatment obtained by a combination of normal-temperature aging and artificial aging (2nd Example). In each of these cases, the difference between the tensile strength of the non-heated part at room temperature and the proof stress of the heated part at room temperature was increased by not less than 20 MPa through the partial reversion heating treatment. Therefore, also in the formability evaluation test, the LDR value showed an improvement by not less than 0.1 as compared with the LDR value obtained without the partial reversion heating treatment. Thus, a formability-enhancing effect effective on a practical-use basis was recognized. In addition, it was also confirmed that an increase in proof stress by not less than 20 MPa was present in the heated part, after the heat treatment equivalent to a coating baking treatment. Thus, a strength level necessary for automobile body sheets could be secured. Further, the time change (variation with time) of the proof stress at the heated part after the partial reversion heating treatment was moderate, and the increase in the proof stress during the period of 5 days after the partial reversion heating treatment was stable at not more than 50 MPa. From this fact it was confirmed that acceptable formed articles free of defective shape or defective appearance can be stably manufactured by press forming. Further, it was proved that the bendability of the heated part heated in the partial reversion heating treatment is good, and, when the bent part of the final press formed product is preliminarily set to be the heated part, bending can be performed.

On the other hand, Condition 11 is Comparative Example in which the proof stress before the partial reversion heating treatment is below the range according to the present invention, though normal-temperature aging is carried out. In this case, even if the subsequent partial reversion heating treatment and the like are carried out in the conditions within the ranges according to the present invention, a sufficient lowering in proof stress cannot be obtained in the heated part heated in the partial reversion heating treatment. Therefore, the difference between the tensile strength of the non-heated part at room temperature and the proof stress of the heated part at room temperature was increased by only less than 20 MPa by the partial reversion heating treatment. Besides, the LDR value obtained upon the formability evaluation test showed only a tiny increase as compared with the LDR value obtained without the partial reversion heating treatment. Thus, a substantial formability-enhancing effect of the partial reversion heating treatment could not be recognized.

The results similar to those obtained with alloy B6 were obtained also with alloy B2, which is an Al—Mg—Si—Cu based alloy. Specifically, all of Conditions 12 to 15 are examples in which alloy 32 was subjected to the partial reversion heating treatment and the like in the conditions within the ranges of the present invention. In each of these cases, the difference between the tensile strength of the non-heated part at room temperature and the proof stress of the heated part at room temperature was increased by not less than 20 MPa through the partial reversion heating treatment. In addition, also in the formability evaluation test, the LDR value showed an increase by not less than 0.1 as compared with the LDR value obtained without the partial reversion heating; thus, a formability-enhancing effect effective on a practical-use basis was recognized. Besides, it was confirmed that an increase in proof stress by not less than 20 MPa was observed at the heated part after the heat treatment equivalent to a coating baking treatment, whereby it was proved that a strength level necessary for automobile body sheets can be secured. Further, the time change (variation with time) of the proof stress at the heated part after the partial reversion heating treatment was moderate, and the increase in the proof stress during the period of 5 days after the partial reversion heating treatment was stable and not more than 50 MPa. From this fact, it was confirmed that acceptable formed articles free of defective shape or defective appearance can be stably manufactured by press forming. Further, it was proved that the bendability of the heated part heated in the partial reversion heating treatment is good, and, when the bent part of the final press formed product is preliminarily set to be the heated part, bending can be facilitated.

On the other hand, Condition 16 relevant to alloy B2 is an example in which the reached heating temperature in the partial reversion heating treatment is below the temperature range of the present invention for ensuring that the difference between the tensile strength of the non-heated part at room temperature and the proof stress of the heated part at room temperature is increased by not less than 20 MPa by the partial reversion heating treatment (1st Example). In this case, a sufficient softening effect of the restoration was not obtainable in the heated part. Besides, the just-mentioned increase was less than 20 MPa. Therefore, it was proved that the LDR value obtained upon the formability evaluation test did not show a sufficient improvement as compared with the LDR value obtained without the partial reversion heating treatment.

In addition, Conditions 17 and 18 relevant to alloy B2 are Comparative Example in which the reached heating temperature in the partial reversion heating treatment is above the range specified in the present invention. In this case, age precipitation proceeds immediately upon completion of restoration in a short time at the heated part, whereby the proof stress at the heated part is raised undesiredly. As a result of this phenomenon, the difference between the tensile strength of the non-heated part at room temperature and the proof stress of the heated part at room temperature was increased by only less than 20 MPa by the partial reversion heating treatment. Therefore, the LDR value obtained upon the formability evaluation test was only comparable to the LDR value obtained without the partial reversion heating treatment. Thus, it was confirmed that formability is substantially not enhanced in this case. In addition, it was found that since intergranular precipitation is induced by the heating at the reached temperature, bendability is lowered largely, so that bending of the formed article cannot be performed. Further, the increase in the proof stress by the post-forming artificial aging at the heated part was only less than 20 MPa. Thus, it was found impossible to secure strength necessary for body panels.

Besides, Condition 19 relevant to alloy B2 is Comparative Example in which the heating time in the partial reversion heating treatment is longer than the range according to the present invention. In this case, although the heated part is once softened since restoration is completed during heating, the heated part is gradually hardened due to progress of age precipitation. As a result of this phenomenon, the difference between the tensile strength of the non-heated part at room temperature and the proof stress of the heated part at room temperature was increased by a minus value (was decreased) through the partial reversion heating treatment. Therefore, the LDR value obtained upon the formability evaluation test was lower than the LDR value obtained without the partial reversion heating treatment. Besides, in this case, bendability after forming of the heated part was poor. It was thus found impossible to bend the formed product.

On the other hand, Condition 20 relevant to alloy B2 is Comparative Example in which, though normal-temperature aging is carried out, the proof stress and the tensile strength before the partial reversion heating treatment are below the ranges according to the present invention. In this case, even if the subsequent partial reversion heating treatment and the like are carried out in the conditions within the ranges of the present invention, a sufficient lowering in proof stress cannot be obtained at the heated part heated in the partial reversion heating treatment. Therefore, the difference between the tensile strength of the non-heated part at room temperature and the proof stress of the heated part at room temperature was increased only less than 20 MPa by the partial reversion heating treatment. In addition, the LDR value obtained upon the formability evaluation test showed only a very tiny rise as compared with the LDR value obtained without the partial reversion heating treatment. Thus, it was found that a formability-enhancing effect of the partial reversion heating treatment is substantially not recognized.

Further, Conditions 21 and 22 relevant to alloy B3 are examples in which normal-temperature aging or artificial aging is conducted in the condition within the relevant range according to the present invention and thereafter the partial reversion heating treatment and the like are conducted in the conditions within the ranges of the present invention (2nd Example). In each of these cases, the difference between the tensile strength of the non-heated part at room temperature and the proof stress of the heated part at room temperature was increased by not less than 20 MPa through the partial reversion heating treatment. Therefore, also in the formability evaluation test, the LDR value showed an improvement by not less than 0.1 as compared with the LDR value obtained without the partial reversion heating treatment. Thus, a formability-enhancing effect effective on a practical-use basis was recognized. In addition, it was also confirmed that an increase in proof stress by not less than 20 MPa was present in the heated part, after the heat treatment equivalent to a coating baking treatment. Thus, a strength level necessary for automobile body sheets could be secured. Further, the increase in the proof stress during the period of 5 days after the partial reversion heating treatment was stable and not more than 50 MPa. From this fact, it was confirmed that acceptable formed articles free of defective shape or defective appearance can be stably manufactured by press forming. Further, it was proved that the bendability of the heated part heated in the partial reversion heating treatment is good, and, when the bent part of the final press formed product is preliminarily set to be the heated part, bending is facilitated.

Example 3

The rolled sheet of alloy B1 used in Example 2 was prepared as a tested specimen, and was subjected to a solution treatment, aging, and a partial reversion heating treatment by a method in which the aging conditions after the solution treatment as well as the conditions such as the reached heating temperature, the heating time, the temperature rise rate, and the cooling rate in the partial reversion heating treatment are the same as Condition 2 shown in Table 4. It should be noted here, however, that in Example 3 the regions of the heated part and the non-heated part in the partial reversion heating treatment were variously modified as shown in Table 8 in carrying out the partial reversion heating treatment. Three days after the partial reversion heating treatment, the blanks having undergone the partial reversion heating treatment in the conditions of the regions were served to a cylinder deep drawing test under the same conditions as in Example 1, to determine the LDR. The results are shown in Table 8.

TABLE 8

| Condition No. | Heated part in partial reversion heating treatment | Non-heated part in partial reversion heating treatment | LDR | Classification |
|---|---|---|---|---|
| 1 | none | none | 2.01 | Comparative Example |
| 2 | whole part | whole part | 2.02 | Comparative Example |
| 3 | outside region of ϕ40 mm circle | inside and outside regions of ϕ40 mm circle | 2.01 | Comparative Example |
| 4 | outside region of ϕ50 mm circle | inside and outside regions of ϕ50 mm circle | 2.02 | Comparative Example |
| 5 | outside region of ϕ55.7 mm circle | inside and outside regions of ϕ55.7 mm circle | 2.26 | Example |
| 6 | outside region of ϕ60 mm circle | inside and outside regions of ϕ60 mm circle | 2.25 | Example |
| 7 | outside region of ϕ70 mm circle | inside and outside regions of ϕ70 mm circle | 2.23 | Example |

Condition 1 as Comparative Example is an example in which no heated region is present; namely, the partial reversion heating treatment was substantially not performed in this example. In this case, LDR was 2.01. Besides, Condition 2 as Comparative Example is an example in which the whole part of the blank is set to be a heated part. In this case, LDR was only slightly increased to 2.02. Thus, a sufficient formability-enhancing effect could not be obtained in this case.

Further, Condition 3 as Comparative Example is an example in which the whole part (region B in FIG. 1) of the portion to be contacted by the punch shoulder part at the time of forming and the whole part (region A in FIG. 1) of the portion on the outer side thereof are set to be the heated part. In this case, the punch shoulder part contact part was lowered in strength, so that this part was liable to break. Therefore, LDR was only 2.01. Thus, it was found that formability is not enhanced in this case.

Condition 4 as Comparative Example is an example in which a part of the portion (region B in FIG. 1) to be contacted by the punch shoulder part at the time of forming and the whole part (region A in FIG. 1) of the portion on the outer side thereof are set to be the heated part. In this case, the punch shoulder part contact part was lowered in strength, so that this part was liable to break. Therefore, LDR was only 2.02. Thus, it was found that formability is not enhanced in this case.

On the other hand, Condition 5 as Example of the present invention is an example in which the whole part (region A in FIG. 1) of the portion on the outer side of the portion (region B in FIG. 1) to be contacted by the punch shoulder part at the time of forming is set to be the heated part. In this case, the blank portion to be contacted by the punch shoulder part is higher in strength than the portion on the outer side thereof. Therefore, LDR was 2.26, which indicates an effective increase by not less than 0.1 as compared with the LDR value obtained without the partial reversion heating treatment. Thus, it was confirmed that formability is enhanced in this case.

Besides, Conditions 6 and 7 as Examples of the present invention are examples in which a part of the portion on the outer side of the portion (region B in FIG. 1) to be contacted by the punch shoulder part at the time of forming is set to be the heated part. In this case, the blank portion to be contacted by the punch shoulder part is higher in strength than the part of the portion on the outer side thereof. Therefore, the LDR values were respectively 2.25 and 2.23, indicating effective increases by not less than 0.1 as compared with the LDR value obtained without the partial reversion heating treatment. Thus, it was confirmed that formability is enhanced in this case.

Example 4

Figure 6:
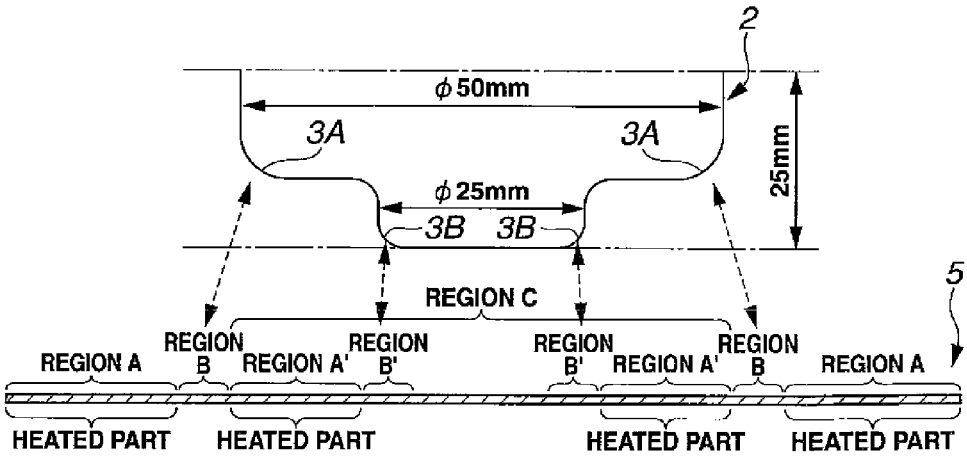
FIG. 6 is a schematic sectional view showing a double-stepped punch of a press used in Example 4 and the positions of a heated part and a non-heated part during a partial reversion heating treatment applied to a blank in Example 4.

The rolled sheet of alloy B1 used in Example 2 was prepared as a tested specimen, and was subjected to a solution treatment, aging, and a partial reversion heating treatment by a method in which the aging conditions after the solution treatment as well as the conditions such as the reached heating temperature, the heating time, the temperature rise rate, and the cooling rate in the partial reversion heating treatment are the same as Condition 2 shown in Table 4. It should be noted here, however, that in Example 4 the shape of the punch for use in press forming was different from those in the above-described examples. Specifically, use was made of a double-stage cylindrical punch 2 having two stages of punch shoulder parts 3A and 3B, as shown in FIG. 6. Here, the first stage of the punch 2 has a size of ϕ50 mm and the punch shoulder part 3A with 5 mmR, while the second stage of the punch 2 has a size of ϕ25 mm and the punch shoulder part 3B with 5 mmR. Further, use was made of a die corresponding to the shape of the double-stage punch 2. Press forming of a disk blank 5 was carried out by use of the double-stage punch 2 and the die.

In Examples of the present invention, the partial reversion heating treatment was conducted by a method in which the region A on the outer side of the region B to be contacted by the first-stage punch shoulder part 3A at the time of forming was set to be the heated part in the partial reversion heating, and the region A', on the outer side of the region B' to be contacted by the punch shoulder part 3B, of the region C on the inner side of the region B, was additionally set to be the heated part. On the other hand, in Comparative Examples, the partial reversion heating treatment was conducted by a method in which only the region A on the outer side of the region B to be contacted by the first-stage punch shoulder part 3A at the time of forming was set to be the heated part in the partial reversion heating treatment. For blanks having undergone respectively the two kinds of partial reversion heating treatments according to Examples of the invention and Comparative Examples, press forming was conducted by use of the punch 2 and the die after three days after the partial reversion heating treatment. As a result, from the blanks according to Examples of the present invention, double-stage cylindrical formed articles could be produced without any braking of the blanks during the forming. On the other hand, the blanks according to Comparative Examples were broken at portions, corresponding to the punch shoulder part 3B, of the formed products.

The invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

Japanese Patent Application Nos. 2007-319453 and is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A cold press forming method for an aluminum alloy sheet, comprising:

providing an Al—Mg—Si based aluminum alloy sheet blank in an age-precipitated state due to normal-temperature aging;

subjecting said aluminum alloy sheet blank to a partial reversion heating treatment; and cold press forming said aluminum alloy sheet blank with a punch while holding down an end part of said aluminum alloy sheet blank, wherein the partial reversion heating treatment comprises the steps of:

rapidly heating a heated part of said aluminum alloy sheet blank at a temperature rise rate of not less than 50° C/min to a temperature in the range of 180 to 350° C. so as to momentarily dissolve age-precipitates and soften said heated part, while a non-heated part of said aluminum alloy sheet blank is not heated, whereby the strength of said heated part is lowered as compared with the strength of said non-heated part;

holding said sheet blank at a temperature in said range for a time of not more than 5 minutes, including (a time of 0 seconds), and then rapidly cooling said heated part to room temperature at a cooling rate of not less than 50° C/min to a temperature of 100° C. or below, where the heated part is the whole part or a smaller-than-whole part of a portion on the outer side of a region of said aluminum alloy sheet blank to be contacted by a punch shoulder part at the time of press forming, and the non-heated part is the other part than said heated part of said aluminum alloy sheet blank, whereby the difference between the tensile strength of said heated part and the 0.2% proof stress of said non-heated part is increased by not less than 20 MPa through said partial reversion heating treatment;

holding said heated part of said rolled sheet between a die and a wrinkle holding down application; and cold press forming said rolled sheet by pushing said non-heated part of said rolled sheet with a punch before the strength of said heated part is returned to the level before said partial reversion heating treatment due to age precipitation during holding at room temperature, so that a limit drawing ratio (LDR) of the cold press forming is higher by at least 0.1 than the LDR in a method without the partial reversion heating treatment.

2. A cold press forming method for an aluminum alloy sheet, comprising:

providing an Al—Mg—Si based aluminum alloy sheet put into an under-aged state by artificial aging at or below 140° C., or an aging treatment conducted by combining normal-temperature aging with artificial aging at or below 140° C., after a solution treatment and having a 0.2% proof stress of not less than 90 MPa;

subjecting said aluminum alloy sheet blank to a partial reversion heating treatment; and cold press forming said aluminum alloy sheet blank with a punch while holding down an end part of said aluminum alloy sheet blank, wherein the partial reversion heating treatment comprises the steps of:

rapidly heating a heated part of said aluminum alloy sheet blank at a temperature rise rate of not less than 50° C/min to a temperature in the range of 180 to 350° C. so as to momentarily dissolve age-precipitates and soften said heated part, while a non-heated part of said aluminum alloy sheet blank is not heated, whereby the strength of said heated part is lowered as compared with the strength of said non-heated part;

holding said sheet blank at a temperature in said range for a time of not more than 5 minutes including (a time of 0 seconds), and then rapidly cooling said heated part to room temperature at a cooling rate of not less than 50° C/min to a temperature of 100° C. or below, where the heated part is the whole part or a smaller-than-whole part of a portion on the outer side of a region of said aluminum alloy sheet blank to be contacted by a punch shoulder part at the time of press forming, and the non-heated part is the other part than said heated part of said aluminum alloy sheet blank, whereby the difference between the tensile strength of said heated part and the 0.2% proof stress of said non-heated part is increased by not less than 20 MPa through said partial reversion heating treatment;

holding said heated part of said rolled sheet between a die and a wrinkle holding down application; and cold press forming said rolled sheet by pushing said non-heated part of said rolled sheet with a punch, so that a limit drawing ratio (LDR) of the cold press forming is higher by at least 0.1 than the LDR in a method without the partial reversion heating treatment before the strength of said heated part is returned to the level before said partial reversion heating treatment due to age precipitation during holding at room temperature, so that a limit drawing ratio (LDR) of the cold press forming is higher by at least 0.1 than the LDR in a method without the partial reversion heating treatment.

3. The cold press forming method for an aluminum alloy sheet as set forth in claim 1 or 2, wherein a part, to be subjected to bending after cold press forming, of a portion on the outer side of a region of said aluminum alloy sheet blank which is to be contacted by a punch shoulder part at the time of cold press forming is included in said heated part in said partial reversion heating treatment.

4. The cold press forming method for an aluminum alloy sheet as set forth in claim 1 or 2, wherein the whole area inside a region of said aluminum alloy sheet blank which is to be contacted by a punch shoulder part at the time of cold press forming, or arbitrary-shaped one or more areas inside said region, are included in said heated part in said partial reversion heating treatment.

5. The cold press forming method for an aluminum alloy sheet as set forth in claims 1 or 2, wherein said Al—Mg—Si based aluminum alloy sheet comprises an aluminum alloy sheet containing 0.2 to 1.5% of Mg, and 0.3 to 2.0% of Si, and containing at least one selected from among 0.03 to 1.0% of Fe, 0.03 to 0.6% of Mn, 0.01 to 0.4% of Cr, 0.01 to 0.4% of Zr, 0.01 to 0.4% of V, 0.005 to 0.3% of Ti, 0.03 to 2.5% of Zn, and 0.01 to 1.5% of Cu, with the balance being Al and unavoidable impurities.

6. The cold press forming method for an aluminum alloy sheet as set forth in claim 1 or 2, wherein the increase amount by which the proof stress value of said heated part heated in said partial reversion heating treatment is increased during the period of five days after said partial reversion heating treatment is set to be not more than 50 MPa.

* * * * *